US009146483B2

(12) United States Patent
Hirose et al.

(10) Patent No.: US 9,146,483 B2
(45) Date of Patent: Sep. 29, 2015

(54) PHOTORECEPTOR, METHOD FOR PREPARING PHOTORECEPTOR, AND IMAGE FORMING APPARATUS AND PROCESS CARTRIDGE USING THE PHOTORECEPTOR

(71) Applicants: Mitsuaki Hirose, Shizuoka (JP); Akihiro Sugino, Shizuoka (JP); Noboru Toriu, Shizuoka (JP); Keisuke Shimoyama, Shizuoka (JP); Tomoharu Asano, Shizuoka (JP)

(72) Inventors: Mitsuaki Hirose, Shizuoka (JP); Akihiro Sugino, Shizuoka (JP); Noboru Toriu, Shizuoka (JP); Keisuke Shimoyama, Shizuoka (JP); Tomoharu Asano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/771,461

(22) Filed: Feb. 20, 2013

(65) Prior Publication Data

US 2013/0243483 A1 Sep. 19, 2013

(30) Foreign Application Priority Data

Mar. 14, 2012 (JP) ..... 2012-056957

(51) Int. Cl.

| | |
|---|---|
| ***G03G 5/047*** | (2006.01) |
| ***G03G 5/147*** | (2006.01) |
| ***G03G 15/00*** | (2006.01) |
| ***G03G 5/05*** | (2006.01) |
| ***G03G 5/06*** | (2006.01) |
| ***G03G 5/07*** | (2006.01) |

(52) U.S. Cl.

CPC ..... *G03G 5/14708* (2013.01); *G03G 5/0546* (2013.01); *G03G 5/0631* (2013.01);*G03G 5/075* (2013.01); *G03G 5/076* (2013.01); *G03G 5/14734* (2013.01); *G03G 5/14752* (2013.01); *G03G 5/14791* (2013.01); *G03G 15/75* (2013.01); *G03G 2215/00957* (2013.01)

(58) Field of Classification Search

CPC ..... G03G 5/0631; G03G 5/0546; G03G 5/14734; G03G 5/14708

USPC ..... 430/66, 59.6, 58.7, 58.5

See application file for complete search history.

(56) References Cited

U.S. PATENT DOCUMENTS

| | | | | |
|---|---|---|---|---|
| 3,575,996 | A * | 4/1971 | Liechtl et al. | 548/219 |
| 4,927,726 | A * | 5/1990 | Scozzafava et al. | 430/78 |
| 5,411,827 | A | 5/1995 | Tamura et al. | |
| 2002/0018953 | A1* | 2/2002 | Maruyama et al. | 430/130 |
| 2005/0158641 | A1* | 7/2005 | Yanagawa et al. | 430/66 |
| 2006/0051688 | A1 | 3/2006 | Toda et al. | |
| 2013/0059242 | A1 | 3/2013 | Asano et al. | |
| 2013/0059243 | A1 | 3/2013 | Hirose et al. | |

FOREIGN PATENT DOCUMENTS

| | | | | |
|---|---|---|---|---|
| JP | 62262052 | A * | 11/1987 | G03G 5/05 |
| JP | 4-281461 | | 10/1992 | |
| JP | 5-173350 | | 7/1993 | |
| JP | 5-216249 | | 8/1993 | |
| JP | 8-262779 | | 10/1996 | |
| JP | 2000-066425 | | 3/2000 | |
| JP | 2006-071856 | | 3/2006 | |
| JP | 2006071856 | A * | 3/2006 | |
| JP | 2006-099028 | | 4/2006 | |
| JP | 2007163577 | A * | 6/2007 | |
| JP | 2010107540 | A * | 5/2010 | |

OTHER PUBLICATIONS

English language machine translation of JP 62-262052 (Nov. 1987).*

English language machine translation of JP 2006-071756 (Mar. 2006).*

English language machine translation of JP 2007-163577 (Jun. 2007).*

* cited by examiner

*Primary Examiner* — Christopher Rodee

(74) *Attorney, Agent, or Firm* — Oblon, McClelland, Maier & Neustadt, L.L.P.

(57) ABSTRACT

In a photoreceptor including an electroconductive substrate; a photosensitive layer; and a protective layer, the protective layer includes a crosslinked resin having a residual group of a polycarboxylic acid compound and a group having the below-mentioned formula (10), and at least one of a compound having the below-mentioned formula (2) and a compound having the below-mentioned formula (3).

(10)

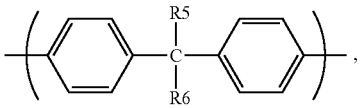

wherein each of R5 and R6 independently represents a hydrogen atom, or a substituted or unsubstituted alkyl group having 1 to 3 carbon atoms.

(2)

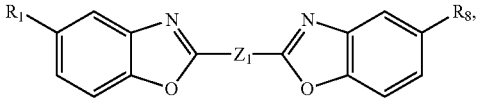

wherein each of $R_7$ and $R_8$ independently represents a hydrogen atom, or an alkyl group having 1 to 4 carbon atoms, and $Z_1$ represents a vinylene group, a divalent aromatic hydrocarbon group having 6 to 14 carbon atoms, or a 2,5-thiophenediyl group.

(3)

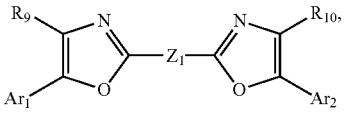

wherein each of $Ar_1$ and $Ar_2$ independently represents an aromatic group having 6 to 14 carbon atoms, $Z_2$ represents a divalent aromatic hydrocarbon group having 6 to 14 carbon atoms, and each of $R_9$ and $R_{10}$ independently represents a hydrogen atom, or a methyl group.

16 Claims, 3 Drawing Sheets

PHOTORECEPTOR, METHOD FOR PREPARING PHOTORECEPTOR, AND IMAGE FORMING APPARATUS AND PROCESS CARTRIDGE USING THE PHOTORECEPTOR

CROSS-REFERENCE TO RELATED APPLICATIONS

This patent application is based on and claims priority pursuant to 35 U.S.C. §119 to Japanese Patent Application No. 2012-056957 filed on Mar. 14, 2012 in the Japan Patent Office, the entire disclosure of which is hereby incorporated by reference herein.

FIELD OF THE INVENTION

The present invention relates to a photoreceptor, a method for preparing a photoreceptor, and an image forming apparatus and a process cartridge using the photoreceptor.

BACKGROUND OF THE INVENTION

Organic photoreceptors provide good performance and have various advantages over inorganic photoreceptors, and therefore organic photoreceptors have been used for image forming apparatus such as copiers, facsimiles, laser printers, and multifunctional products having two or more of copying, facsimileing, printing functions instead of inorganic photoreceptors.

In general, a protective layer is formed on such organic photoreceptors to prevent abrasion of the photoreceptors due to mechanical stresses applied thereto by developing systems and cleaning systems of the image forming apparatus for which the photoreceptors are used.

When such organic photoreceptors are charged by a corona charger in image forming apparatus, the organic photoreceptors cause an uneven density problem in that when the photoreceptors are repeatedly used for a long period of time and are charged by the corona charger after a long pause, a strip-shaped uneven density image having the same width as the width of the corona charger is formed.

An electrophotographic photoreceptor having an electroconductive substrate, a photosensitive layer located on the electroconductive substrate, and a protective layer located on the photosensitive layer is disclosed, wherein the protective layer is formed by applying a coating liquid including a binder resin component including a specific crosslinkable acrylic monomer and a particulate electroconductive metal oxide on the photosensitive layer, and then crosslinking the applied coating liquid.

However, it is difficult for the photoreceptor to have good abrasion resistance while preventing occurrence of an irradiated-portion potential increasing problem in that the potential of irradiated portions of the photoreceptor increases after the photoreceptor is used for a long period of time.

For these reasons, the inventors recognized that there is a need for a photoreceptor which has good abrasion resistance and which does not cause the uneven density problem while preventing occurrence of the irradiated-portion potential increasing problem.

BRIEF SUMMARY OF THE INVENTION

As an aspect of the present invention, a photoreceptor is provided which includes an electroconductive substrate; a photosensitive layer located overlying the electroconductive substrate; and a protective layer located overlying the photosensitive layer. The protective layer includes:

a crosslinked resin including a residual group of a polycarboxylic acid compound and a group having the following formula (10):

(10)

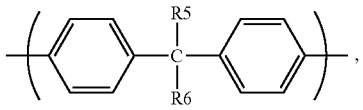

wherein each of R5 and R6 independently represents a hydrogen atom, or a substituted or unsubstituted alkyl group having 1 to 3 carbon atoms; and at least one of a compound having the below-mentioned formula (2) and a compound having the below-mentioned formula (3):

(2)

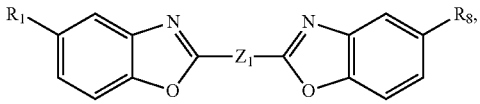

wherein each of $R_7$ and $R_8$ independently represents a hydrogen atom, or an alkyl group having 1 to 4 carbon atoms, and $Z_1$ represents a vinylene group, a divalent aromatic hydrocarbon group having 6 to 14 carbon atoms, or a 2,5-thiophenediyl group, and (3)

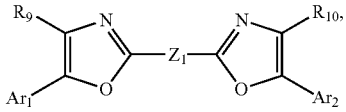

wherein each of $Ar_1$ and $Ar_2$ independently represents an aromatic group having 6 to 14 carbon atoms, $Z_2$ represents a divalent aromatic hydrocarbon group having 6 to 14 carbon atoms, and each of $R_9$ and $R_{10}$ independently represents a hydrogen atom, or a methyl group.

In this regard, "overlying" can include direct contact and allow for one or more intermediate layers.

As another aspect of the present invention, a method for preparing a photoreceptor is provided which includes forming a photosensitive layer overlying an electroconductive substrate; applying a coating liquid including a composition including a radically polymerizable compound having a charge transport structure, a compound having the below-mentioned formula (1), and at least one of a compound having the above-mentioned formula (2) and a compound having the above-mentioned formula (3) overlying the photosensitive layer; and irradiating the applied coating liquid with activation energy rays to crosslink the composition, thereby forming a cover layer overlying the photosensitive layer.

(1)

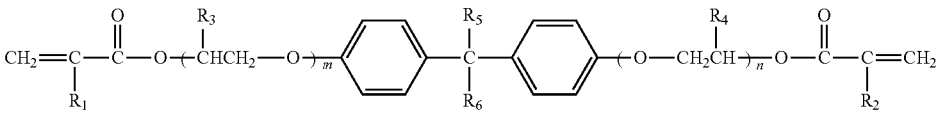

wherein each of $R_1$, $R_2$, $R_3$, $R_4$, $R_5$ and $R_6$ independently represents a hydrogen atom, or a substituted or unsubstituted alkyl group having 1 to 3 carbon atoms, and each of m and n is independently an integer of from 1 to 5

As yet another aspect of the present invention, an image forming apparatus is provided which includes the above-mentioned photoreceptor; a charger to subject a surface of the photoreceptor to corona charging; an irradiator to irradiate the charged photoreceptor with light to form an electrostatic latent image on the surface of the photoreceptor; a developing device to develop the electrostatic latent image with a developer including a toner to form a toner image on the surface of the photoreceptor; and a transferring device to transfer the toner image onto a recording medium.

As a further aspect of the present invention, a process cartridge is provided which includes at least the above-mentioned photoreceptor; and a charger to subject a surface of the photoreceptor to corona charging. The process cartridge is detachably attachable to an image forming apparatus as a single unit.

The aforementioned and other aspects, features and advantages will become apparent upon consideration of the following description of the preferred embodiments taken in conjunction with the accompanying drawings.

DETAILED DESCRIPTION OF THE INVENTION

Figure 1:
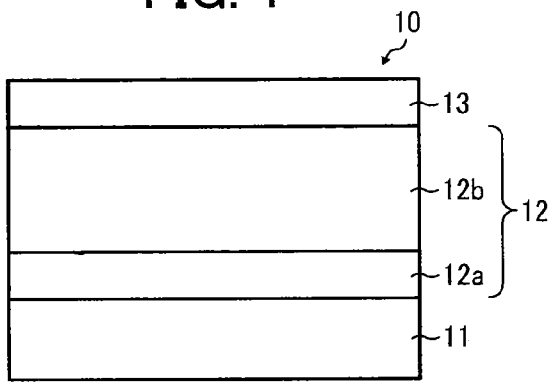
FIG. 1 is a schematic cross-sectional view illustrating an example of the photoreceptor of the present invention.

The present invention will be described by reference to drawings.

The photoreceptor of the present invention includes an electroconductive substrate, a photosensitive layer located overlying the electroconductive substrate, and a protective layer located overlying the photosensitive layer. The protective layer includes:

a crosslinked resin including a residual group of a polycarboxylic acid compound and a group having the following formula (10):

(10)

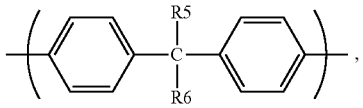

wherein each of R5 and R6 independently represents a hydrogen atom, or a substituted or unsubstituted alkyl group having 1 to 3 carbon atoms; and at least one of a compound having the below-mentioned formula (2) and a compound having the below-mentioned formula (3):

(2)

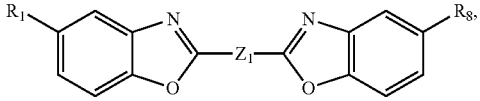

wherein each of $R_7$ and $R_8$ independently represents a hydrogen atom, or an alkyl group having 1 to 4 carbon atoms, and $Z_1$ represents a vinylene group, a divalent aromatic hydrocarbon group having 6 to 14 carbon atoms, or a 2,5-thiophenediyl group, and (3)

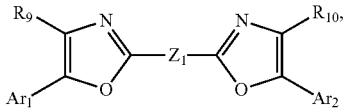

wherein each of $Ar_1$ and $Ar_2$ independently represents an aromatic group having 6 to 14 carbon atoms, $Z_2$ represents a divalent aromatic hydrocarbon group having 6 to 14 carbon atoms, and each of $R_9$ and $R_{10}$ independently represents a hydrogen atom, or a methyl group.

In this regard, "overlying" can include direct contact and allow for one or more intermediate layers.

The group of the crosslinked resin preferably has the following formula (11):

(11)

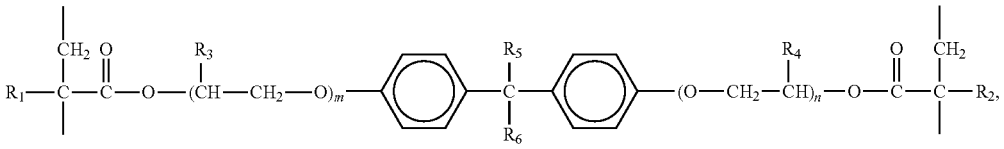

wherein each of $R_1$, $R_2$, $R_3$, $R_4$, $R_5$ and $R_6$ independently represents a hydrogen atom, or a substituted or unsubstituted alkyl group having 1 to 3 carbon atoms, and each of m and n is independently an integer of from 1 to 5.

The protective layer is preferably formed by crosslinking a protective layer composition including a radically polymerizable compound having a charge transport structure, a compound having the below-mentioned formula (1), and at least one of a compound having the above-mentioned formula (2) and a compound having the above-mentioned formula (3).

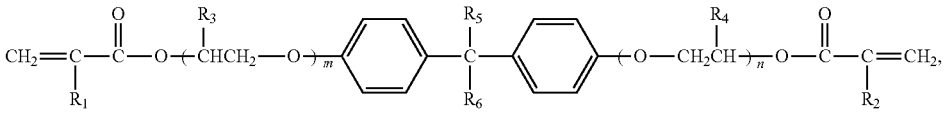

(1)

wherein each of $R_1$, $R_2$, $R_3$, $R_4$, $R_5$ and $R_6$ independently represents a hydrogen atom, or a substituted or unsubstituted alkyl group having 1 to 3 carbon atoms, and each of m and n is independently an integer of from 1 to 5.

It is considered that since the protective layer has such a configuration, formation of a charge trap in the protective layer can be prevented. As a result, the photoreceptor has good abrasion resistance and does not cause the uneven density problem and the irradiated-portion potential increasing problem even when the photoreceptor is used for a long period of time. Therefore, the photoreceptor can produce such high quality images as to be used for commercial printing.

In this regard, since compounds having formula (1) are difunctional and have a bulky structure, the compounds have poor reactivity. Therefore, in order to enhance the abrasion resistance of the resultant photoreceptor, irradiance of activation energy rays has to be increased. In this regard, if a compound having formula (2) or a compound having formula (3) is not included in the protective layer composition, the potential of irradiated portions of the photoreceptor increases. The reason why the potential of irradiated portions of the photoreceptor increases is considered to be that the radically polymerizable compound having a charge transport structure included in the protective layer composition is decomposed and thereby charge traps are formed in the protective layer.

It is considered that by adding a compound having formula (2) or a compound having formula (3) to the protective layer composition, such a radically polymerizable compound having a charge transport structure, which has achieved an excited state by being irradiated with activation energy rays, and the compound (2) or (3) form an exciplex (i.e., a complex material achieving an excited state), followed by deactivation, thereby making it possible to prevent decomposition of the radically polymerizable compound having a charge transport structure.

Since compounds having formula (2) or (3) have a larger oxidation potential than radically polymerizable compounds having a charge transport structure, the compounds do not form charge traps in the protective layer. In addition, since compounds having formula (2) or (3) absorb ultraviolet rays in a small amount, the compounds hardly interfere with the crosslinking reaction. Further, since compounds having formula (2) or (3) have a lower excitation potential than radically polymerizable compounds having a charge transport structure, exciplex can be easily formed.

Accordingly, by adding a compound having formula (2) or (3) to the protective layer composition, the resultant photoreceptor can have good abrasion resistance and does not cause the irradiated-portion potential increasing problem even when the photoreceptor is used for a long period of time.

FIG. 1 is a schematic cross-sectional view illustrating an example of the photoreceptor of the present invention. Referring to FIG. 1, a photoreceptor 10 includes an electroconductive substrate 11, a photosensitive layer 12 located on the electroconductive substrate 11, and a protective layer 13 located on the photosensitive layer 12. The photosensitive layer 12 includes a charge generation layer 12*a* and a charge transport layer 12*b*. The positions of the charge generation layer 12*a* and the charge transport layer 12*b* are not limited thereto, and the charge generation layer 12*a* may be formed on the charge transport layer 12*b*.

The protective layer 13 is formed by crosslinking a protective layer composition including a radically polymerizable compound having a charge transport structure, a compound having formula (1), and at least one of a compound having formula (2) and a compound having formula (3).

In this regard, the protective layer composition means solid components, and liquid components to form solid components when irradiated with excitation energy rays included in the protective layer coating liquid.

Compounds having formula (1) are considered to fill spaces of a three dimensional network formed in the protective layer because of having a bulky structure due to the bisphenol A skeleton therein, thereby enhancing the gas shielding property of the protective layer.

Among the compounds having formula (1), compounds having a formula in which each of m and n independently 1 or 2, and the total of m and n is 2 or 3 in formula (1) are preferable to impart good gas shielding property to the protective layer.

Specific examples of compounds having formula (1) include compounds having formulae (1-1) to (1-4), but are not limited thereto.

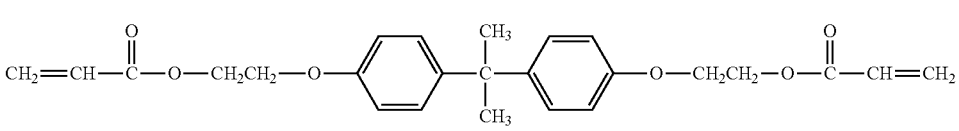

(1-1)

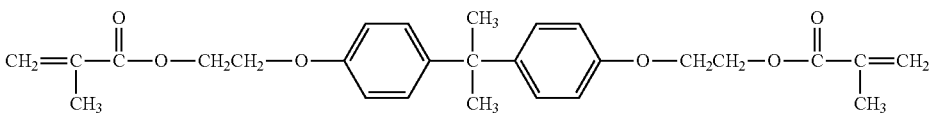

(1-2)

-continued

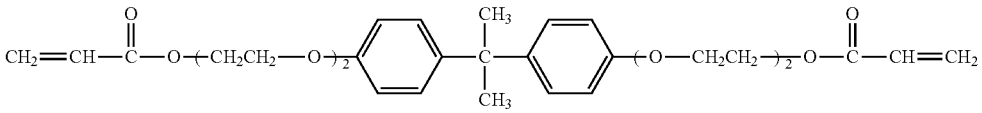

(1-3)

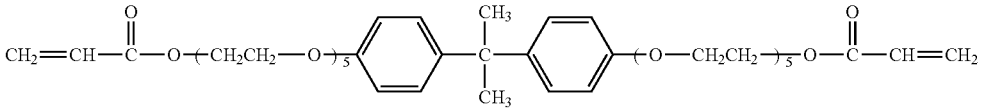

(1-4)

The weight ratio of a compound having formula (1) to a radically polymerizable compound having a charge transport structure in the protective layer composition is generally from 3/7 to 7/3, and preferably from 4/6 to 6/4. When the weight ratio is less than 3/7, the uneven density problem tends to be caused when the photoreceptor is used for image forming apparatus using a corona charger for a long period of time. In contrast, when the weight ratio is greater than 7/3, it often becomes difficult for the resultant photoreceptor to have good abrasion resistance while preventing occurrence of the irradiated-portion potential increasing problem.

The content of a compound having formula (1) in the protective layer composition is generally from 10% to 90% by weight, and preferably from 30% to 80% by weight, based on the weight of the protective layer composition. When the content is less than 10% by weight, the uneven density problem tends to be caused when the photoreceptor is used for image forming apparatus using a corona charger for a long period of time. In contrast, when the content is greater than 90% by weight, it often becomes difficult for the resultant photoreceptor to have good abrasion resistance while preventing occurrence of the irradiated-portion potential increasing problem.

In this regard, whether the protective layer of the photoreceptor includes a group having formula (1), (10) or (11) can be determined by subjecting the protective layer, which remains on the photoreceptor, or the protective layer peeled from the photoreceptor to FT-IR or gas chromatograph mass spectrometry.

Specific examples of the alkyl group having 1 to 4 carbon atoms for use as the groups $R_7$ and $R_8$ in formula (2) include a methyl group, an ethyl group, a n-propyl group, an isopropyl group, a n-butyl group, an isobutyl group, a sec-butyl group, and a tert-butyl group, but are not limited thereto.

Specific examples of the divalent aromatic hydrocarbon group having 6 to 14 carbon atoms for use as the group $Z_1$ in formula (2) include an o-phenylene group, a p-phenylene group, 1,4-naphthalenediyl group, 9,10-anthracenediyl group, 1,4-anthracenediyl group, 4,4'-biphenyldiyl group, and 4,4'-stilbenediyl group, but are not limited thereto.

Specific examples of the monovalent aromatic hydrocarbon group having 6 to 14 carbon atoms for use as the groups $Ar_1$ and $Ar_2$ in formula (3) include a phenyl group, a 4-methylphenyl group, a 4-tert-butylphenyl group, a naphthyl group, and a biphenyl group, but are not limited thereto.

Specific examples of the divalent aromatic hydrocarbon group having 6 to 14 carbon atoms for use as the group $Z_2$ in formula (3) include an o-phenylene group, a p-phenylene group, 1,4-naphthalenediyl group, 9,10-anthracenediyl group, 1,4-anthracenediyl group, 4,4'-biphenyldiyl group, and 4,4'-stilbenediyl group, but are not limited thereto.

Specific examples of the compound having formula (2) include compounds having the following formulae (2-1) to (2-9), but are not limited thereto.

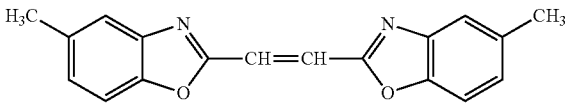

(2-1)

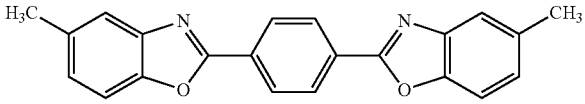

(2-2)

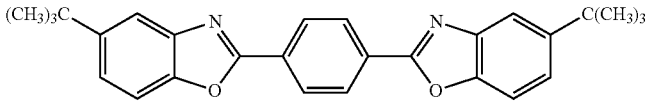

(2-3)

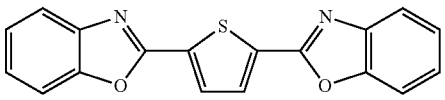

(2-4)

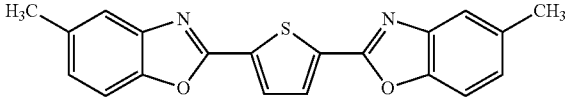

(2-5)

-continued (2-6)

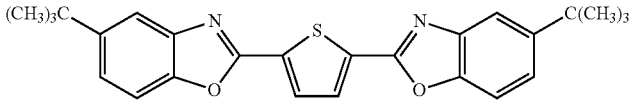

(2-7)

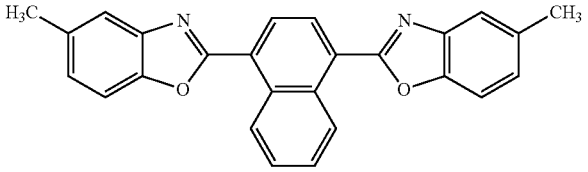

(2-8)

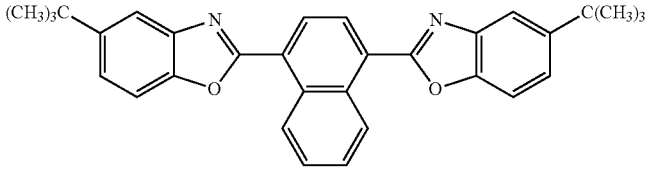

(2-9)

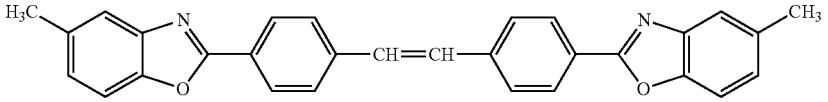

Specific examples of the compound having formula (3) include compounds having the following formulae (3-1) to (3-4), but are not limited thereto.

(3-1)

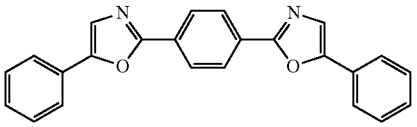

(3-2)

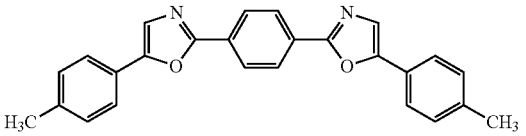

(3-3)

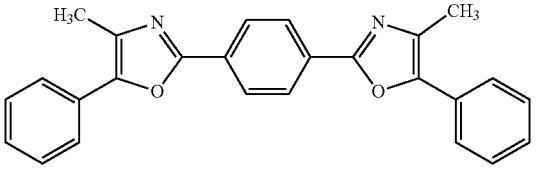

(3-4)

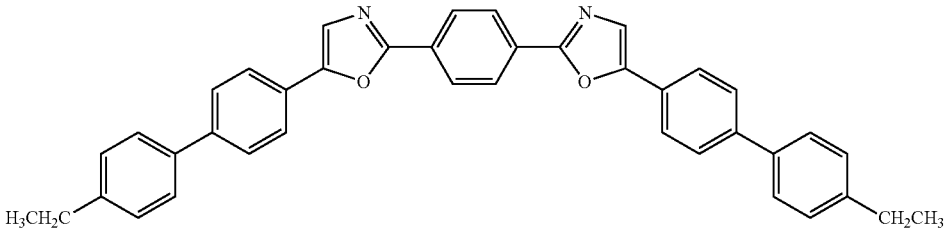

The weight ratio of a compound having formula (2) or (3) to a radically polymerizable compound having a charge transport structure is generally from 0.5/100 (0.5%) to 10/100 (10%), and preferably from 0.5/100 (0.5%) to 5/100 (5%). When the weight ratio is less than 0.5%, the irradiated-portion potential increasing problem tends to be caused. When the weight ratio is greater than 10%, the abrasion resistance of the resultant photoreceptor tends to deteriorate.

The content of a compound having formula (2) or (3) in the protective layer composition is generally from 0.1% to 5% by weight, and preferably from 0.1% to 3% by weight, based on the weight of the protective layer composition. When the content is less than 0.1% by weight, the irradiated-portion potential increasing problem tends to be caused. When the content is greater than 5% by weight, the abrasion resistance of the resultant photoreceptor tends to deteriorate.

The radically polymerizable compound means a compound having a radically polymerizable group.

Specific examples of the radically polymerizable group include groups having the following formula (4) or (5).

$$CH_2{=}CH{-}X_1{-} \quad (4)$$

wherein $X_1$ represents a substituted or unsubstituted arylene group, a substituted or unsubstituted alkenylene group, a carbonyl group, a carbonyloxy group, a thio group, or a —CONR— group (wherein R represents a hydrogen atom, an alkyl group, an aralkyl group (e.g., a benzyl group, a naphthylmethyl group, and a phenethyl group), or an aryl group (e.g., a phenyl group, and a naphthyl group)).

$$CH_2{=}C(Y){-}X_2{-} \quad (5)$$

wherein Y represents a substituted or unsubstituted alkyl group, a substituted or unsubstituted aralkyl group, a substituted or unsubstituted aryl group (e.g., a phenyl group, and a naphthyl group), a halogen atom, a cyano group, a nitro group, an alkoxyl group (e.g., a methoxy group, and an ethoxy group), a —COOR— group (wherein R represents a hydrogen atom, a substituted or unsubstituted alkyl group, a substituted or unsubstituted aralkyl group, or an aryl group), or a $—CONR_1R_2—$ group (wherein each of $R_1$ and $R_2$ independently represents a hydrogen atom, a substituted or unsubstituted alkyl group, a substituted or unsubstituted aralkyl group, or a substituted or unsubstituted aryl group); and $X_2$ represents a direct bond, an alkylene group, a substituted or unsubstituted arylene group, a substituted or unsubstituted arkenylene group, a carbonyl group, a carbonyloxy group, a thio group, or a $—CONR_3—$ group (wherein $R_3$ represents a hydrogen atom, an alkyl group, an aralkyl group, or an aryl group).

Among these groups, acryloyloxy group or a methacryloyloxy group is preferable as the radically polymerizable group.

Specific examples of the arylene group for use as the group $X_1$ in formula (4) include a phenylene group, and a naphthylene group, but are not limited thereto.

Specific examples of the alkyl group for use as the group R in formula (4) include a methyl group and an ethyl group, but are not limited thereto.

Specific examples of the aralkyl group for use as the group R in formula (4) include a benzyl group, a naphthylmethyl group, and a phenethyl group, but are not limited thereto.

Specific examples of the aryl group for use as the group R in formula (4) include a phenyl group, and a naphthyl group, but are not limited thereto.

Specific examples of the alkyl group for use as the groups $R_1$, $R_2$ and $R_3$ in formula (5) include a methyl group and an ethyl group, but are not limited thereto.

Specific examples of the aralkyl group for use as the groups $R_1$, $R_2$ and $R_3$ in formula (5) include a benzyl group, a naphthylmethyl group, and a phenethyl group, but are not limited thereto.

Specific examples of the aryl group for use as the groups $R_1$, $R_2$ and $R_3$ in formula (5) include a phenyl group, and a naphthyl group, but are not limited thereto.

Specific examples of the arylene group for use as the group $X_2$ in formula (5) include a phenylene group, and a naphthylene group, but are not limited thereto.

Specific examples of the substituents for the groups $X_1$, $X_2$ and Y in formulae (4) and (5) include a halogen atom, a nitro group, a cyano group, an alkyl group (e.g., a methyl group, and an ethyl group), an alkoxy group (e.g., a methoxy group, and an ethoxy group), an aryloxy group (e.g., a phenoxy group), an aryl group (e.g., a phenyl group, and a naphthyl group), and an aralkyl group (e.g., a benzyl group, and a phenethyl group), but are not limited thereto.

Specific examples of the group having formula (4) include a vinyl group, a styryl group, a 2-methyl-1,3-butadienyl group, a vinylcarbonyl group, an acryloyloxy group, an acryloylamide group, and a vinylthio group, but are not limited thereto.

Specific examples of the group having formula (5) include an α-chloroacryloyloxy group, a methacryloyloxy group, an α-cyanovinyl group, an α-cyanoacryloyloxy group, an α-cyanovinylidenephenylene group, and a methacryloylamino group, but are not limited thereto.

Specific examples of the radically polymerizable compound having a charge transport structure include compounds having a positive hole transporting property such as triarylamine, hydrazone, pyrazoline, and carbazole; and compounds having an electron transporting property such as condensed polycyclic quinones, diphenoquinone, and aromatic compounds having an electron absorbing property (e.g., a cyano group and a nitro group). Among these compounds, triarylamine is preferable.

Among radically polymerizable compounds having a charge transport structure, monofunctional compounds, which have one radically polymerizable group, are preferable from the viewpoint of the potential of irradiated portions of the resultant photoreceptor.

The radically polymerizable compound having a charge transport structure to be included in the protective layer composition preferably has the following formula (4).

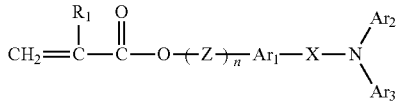

(6)

wherein $R_1$ represents a hydrogen atom, a halogen atom, a substituted or unsubstituted alkyl group, a substituted or unsubstituted aralkyl group, a substituted or unsubstituted aryl group, a cyano group, a nitro group, an alkoxyl group, a $—COOR_2$ group (wherein $R_2$ represents a hydrogen atom, a substituted or unsubstituted alkyl group, a substituted or unsubstituted aralkyl group, or a substituted or unsubstituted aryl group), a halogenated carbonyl group, or a $—CONR_3R_4$ group (wherein each of $R_3$ and $R_4$ independently represents a hydrogen atom, a halogen atom, a substituted or unsubstituted alkyl group, a substituted or unsubstituted aralkyl group, or a substituted or unsubstituted aryl group); $Ar_1$ represents a substituted or unsubstituted divalent aromatic group; each of $Ar_2$ and $Ar_3$ independently represents a substituted or unsubstituted monovalent aromatic group; X represents a $—Y—Ar_4—$ group (wherein Y represents a direct bond, a substituted or unsubstituted alkylene group, a substituted or unsubstituted cycloalkylene group, a substituted or unsubstituted alkyleneoxy group, a thio group, or a vinylene group, and $Ar_4$ represents a substituted or unsubstituted divalent aromatic group); Z represents a substituted or unsubstituted alkylene group, a substituted or unsubstituted divalent alkyleneoxy group, or a substituted or unsubstituted alkyleneoxy carbonyl group; and n is 0 or an integer of from 1 to 3.

Specific examples of the alkyl group for use as the group $R_1$ in formula (6) include a methyl group, an ethyl group, a propyl group, and a butyl group, but are not limited thereto.

Specific examples of the aralkyl group for use as the group $R_1$ in formula (6) include a benzyl group, a phenethyl group, and a naphthylmethyl group, but are not limited thereto. Specific examples of the aryl group for use as the group $R_1$ in formula (6) include a phenyl group, and a naphthyl group, but are not limited thereto.

Specific examples of the alkoxy group for use as the group $R_1$ in formula (6) include a methoxy group, an ethoxy group, and a propoxy group, but are not limited thereto.

Specific examples of the substituents for the group $R_1$ in formula (6) include a halogen atom, a nitro group, a cyano group, an alkyl group (e.g., a methyl group, and an ethyl group), an alkoxy group (e.g., a methoxy group, and an ethoxy group), an aryloxy group (e.g., a phenoxy group), an aryl group (e.g., a phenyl group, and a naphthyl group), and an aralkyl group (e.g., a benzyl group, and a phenethyl group), but are not limited thereto.

The group $R_1$ in formula (6) is preferably a hydrogen atom, or a methyl group.

Examples of the monovalent aromatic group for use as the groups $Ar_1$ and $Ar_2$ in formula (6) include condensed monovalent polycyclic hydrocarbon groups, non-condensed monovalent polycyclic hydrocarbon groups, and monovalent heterocyclic groups.

Specific examples of the condensed polycyclic hydrocarbon groups include pentanyl, indecenyl, naphthyl, azulenyl, heptalenyl, biphenilenyl, as-indacenyl, s-indacenyl, fluorenyl, acenaphthylenyl, preiadenyl, acenaphthenyl, phenarenyl, phenanthoryl, anthoryl, fluorantenyl, acephenanthorylenyl, aceanthorylenyl, triphenylenyl, pyrenyl, chrysenyl, and naphthasenyl groups.

In this regard, the number of carbon atoms constituting the ring of the condensed polycyclic hydrocarbon groups is preferably not greater than 18.

Specific examples of the non-condensed monovalent polycyclic hydrocarbon groups include groups derived from monocyclic hydrocarbon compounds such as benzene, diphenyl ether, polyethylene diphenyl ether, diphenyl thioether, and diphenyl sulfone; groups derived from polycyclic hydrocarbon compounds such as biphenyl, polyphenyl, diphenyl alkanes, diphenylalkenes, diphenyl alkynes, triphenyl methane, distyryl benzene, 1,1-diphenylcycloalkanes, polyphenyl alkanes, and polyphenyl alkenes; and groups derived from ring of sets of hydrocarbons such as 9,9-diphenyl fluorenone.

Specific examples of the heterocyclic groups include groups derived from heterocyclic aromatic compounds such as carbazole, dibenzofuran, dibenzothiophene, oxadiazole, and thiadiazole.

Specific examples of the substituent for the groups $Ar_2$ and $Ar_3$ include the following groups.

(1) Halogen atoms, a cyano group, and a nitro group.

(2) Alkyl groups which preferably have from 1 to 12 carbon atoms, more preferably from 1 to 8 carbon atoms, and even more preferably from 1 to 4 carbon atoms. These alkyl groups can be further substituted with another group such as a fluoro group, a hydroxyl group, a cyano group, an alkoxyl group having 1 to 4 carbon atoms, and a phenyl group which may be further substituted with a halogen atom, an alkyl group having 1 to 4 carbon atoms, or an alkoxyl group having 1 to 4 carbon atoms. Specific examples of the alkyl groups include methyl, ethyl, n-propyl, iso-propyl, n-butyl, sec-butyl, t-butyl, trifluoromethyl, 2-hydroxyethyl, 2-ethoxyethyl, 2-cyanoethyl, 2-methoxyethyl, benzyl, 4-chlorobenzyl, 4-methylbenzyl, and 4-phenylbenzyl groups.

(3) Alkoxyl groups. Specific examples of the alkyl group constituting the alkoxy group include the alkyl groups mentioned above in paragraph (2). Specific examples of the alkoxyl groups include methoxy, ethoxy, n-propoxy, iso-propoxy, t-butoxy, n-butoxy, s-butoxy, iso-butoxy, 2-hydroxyethoxy, benzyloxy, and trifluoromethoxy groups.

(4) Aryloxy groups. Specific examples of the aryl group constituting the acryloxy groups include phenyl and naphthyl groups. The aryloxy groups may be substituted with an alkoxyl group having from 1 to 4 carbon atoms, an alkyl group having from 1 to 4 carbon atoms, or a halogen atom. Specific examples of the aryloxy groups include phenoxy, 1-naphthyloxy, 2-naphthyloxy, 4-methoxyphenoxy, and 4-methylphenoxy groups.

(5) Alkylmercapto or arylmercapto groups. Specific examples of the alkylmercapto groups include methylthio, and ethylthio groups. Specific examples of the arylmercapto groups include phenylthio and p-methylphenylthio groups.

(6) Substituted or unsubstituted amino groups having a formula —$NR_1R_2$, wherein each of $R_1$ and $R_2$ independently represents a hydrogen atom, one of the alkyl groups mentioned above in paragraph (2), or an aryl group, wherein $R_1$ and $R_2$ optionally share bond connectivity to form a ring.

The aryl group for use as the group $R_1$ and $R_2$ may be substituted with another group such as an alkoxyl group having from 1 to 4 carbon atoms, an alkyl group having from 1 to 4 carbon atoms, and a halogen atom.

Specific examples of the aryl group include phenyl, biphenyl and naphthyl groups.

Specific examples of the substituted or unsubstituted amino groups include an amino group, a diethylamino group, a N-methyl-N-phenylamino group, a N,N-diphenylamino group, a N,N-ditolylamino group, a dibenzylamino group, a piperidino group, a morpholino group, and a pyrrolidino group.

(7) Alkylenedioxy or alkylenedithio groups such as a methylenedioxy group, and a methylenedithio group.

(8) Other groups such as substituted or unsubstituted styryl groups, substituted or unsubstituted β-phenylstyryl groups, diphenylaminophenyl groups, and ditolylaminophenyl groups.

Suitable groups for use as the divalent aromatic groups $Ar_1$ and $Ar_4$ include divalent groups derived from the monovalent aromatic groups mentioned above for use as the groups $Ar_2$ and $Ar_3$.

The number of carbon atoms in the alkylene group used for the group Y is generally from 1 to 12, preferably from 1 to 8, and more preferably from 1 to 4.

The alkylene group can be substituted with another group such as a fluoro group, a hydroxyl group, a cyano group, an alkoxyl group having 1 to 4 carbon atoms, and a phenyl group which may be further substituted with a halogen atom, an alkyl group having 1 to 4 carbon atoms, or an alkoxyl group having 1 to 4 carbon atoms.

Specific examples of the alkylene groups include a methylene group, an ethylene group, a n-propylene group, an iso-propylene group, a n-butylene group, a sec-butylene group, a t-butylene group, a trifluoromethylene group, a 2-hydroxyethylene group, a 2-ethoxyethylene group, a 2-cyanoethylene group, a 2-methoxyethylene group, a benzylidene group, a phenylethylene group, a 4-chlorophenylethylene group, a 4-methylphenylethylene group, and a 4-biphenylethylene group.

The number of carbon atoms of the cycloalkylene group used for the group Y is generally from 5 to 7.

The cycloalkylene group may be substituted with a fluoro group, a hydroxyl group, an alkyl group having 1 to 4 carbon atoms, or an alkoxyl group having 1 to 4 carbon atoms.

Specific examples of the substituted or unsubstituted cycloalkylene groups include cyclohexylidene, cyclohexylene, and 3,3-dimethylcyclohexylidene groups.

Specific examples of the alkyleneoxy group used for the group Y include groups, —$CH_2CH_2O$—, —$CH_2CH_2CH_2O$—, —$(OCH_2CH_2)_nO$— (n is an integer of 1 to 4), and —$(OCH_2CH_2CH_2)_mO$— (m is an integer of 1 to 4).

The alkyleneoxy group may be substituted with a group such as hydroxyl, methyl, and ethyl groups.

Suitable groups for use as the vinylene group include groups having one of the following formulae.

$$—(C(R_1)=CH)_n—$$

wherein $R_1$ represents a hydrogen atom, one of the alkyl groups mentioned above for use in paragraph (2), or one of the divalent aromatic groups mentioned above for use as the groups $Ar_2$ and $Ar_3$, wherein n is 1 or 2.

$$—C(R_2)=CH—(CH=CH)_m—$$

wherein $R_2$ represents a hydrogen atom, one of the alkyl groups mentioned above for use in paragraph (2), or one of the divalent aromatic groups mentioned above for use as the groups $Ar_2$ and $Ar_3$, wherein m is 1, 2 or 3.

Specific examples of the alkylene group for use as the group Z include the alkylene groups mentioned above for use as the group Y.

Specific examples of the alkyleneoxy group for use as the group Z include the alkyleneoxy groups mentioned above for use as the group Y.

Specific examples of the alkyleneoxycarbonyl group for use as the group Z include alkyleneoxy groups modified by caprolactone.

The monofunctional radically polymerizable compound having a charge transport structure preferably has the following formula (7).

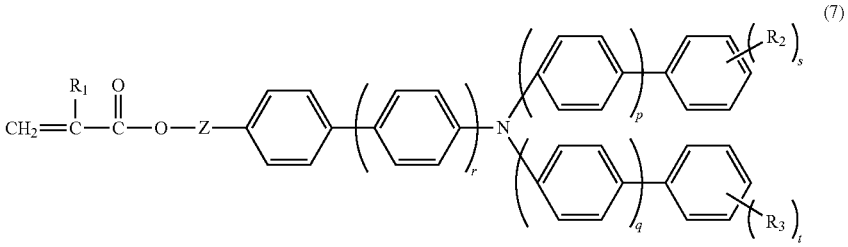

(7)

wherein each of r, p and q is 0 or 1; $R_1$ represents a hydrogen atom, or a methyl group; each of $R_2$ and $R_3$ independently represents an alkyl group having 1 to 6 carbon atoms, wherein each of $R_2$ and $R_3$ can include plural groups which are the same as or different from each other; each of s and t is independently 0, 1, 2 or 3; Z represents a direct bond, a methylene group, an ethylene group, or a group having one of the following formulae.

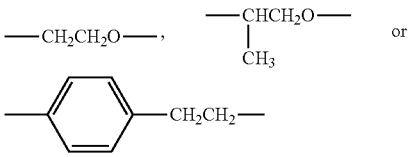

In formula (7), it is preferable that each of $R_2$ and $R_3$ is independently a methyl group or an ethyl group.

The content of a radically polymerizable compound having a charge transport structure in the protective layer composition is generally from 20% to 80% by weight, and preferably from 35% to 65% by weight. When the content is less than 20% by weight, the of irradiated-portion potential increasing problem tends to be caused. When the content is greater than 80% by weight, the abrasion resistance of the resultant photoreceptor tends to deteriorate.

It is preferable that the protective layer composition further includes a radically polymerizable tri- or more-functional compound having no charge transport structure. The three or more radically polymerizable groups included in the tri- or more-functional radically-polymerizable compound may be the same as or different from each other.

Specific examples of such polymerizable compounds having three or more radically polymerizable functional groups include, but are not limited thereto, trimethylolpropane triacrylate (TMPTA), trimethylolpropane trimethacylate, ethyleneoxy-modified trimethylolpropane triacrylate, propyleneoxy-modified trimethylolpropane triacrylate, caprolactone-modified trimethylolpropane triacrylate, HPA-modified trimethylolpropane trimethacrylate, pentaerythritol triacrylate, pentaerythritol tetraacrylate (PETTA), glycerol triacrylate, epichlorohydrin-modified glycerol triacrylate, ethyleneoxy-modified glycerol triacrylate, propyleneoxy-modified glycerol triacrylate, tris(acryloxyethyl)isocyanurate, dipentaerythritol hexaacrylate (DPHA), caprolactone-modified dipentaerythritol hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerhythritol ethoxytriacrylate, ethyleneoxy-modified triacryl phosphate, and 2,2,5,5-tetrahydroxymethylcyclopentanone tetraacrylate. These compounds can be used alone or in combination.

The radically polymerizable tri- or more-functional compound having no charge transport structure to be included in the protective layer composition preferably has a functional-group equivalent (i.e., a ratio of the molecular weight of a compound to the number of the functional groups included in the compound) of not less than 300.

The content of a radically polymerizable tri- or more-functional compound having no charge transport structure in the protective layer composition is generally not greater than 50% by weight, and preferably not greater than 30% by weight. When the content is greater than 50% by weight, the irradiated-portion potential increasing problem tends to be caused.

The protective layer composition can optionally include a radically polymerizable difunctional compound and/or oligomer having no charge transport structure other than compounds having formula (1).

Specific examples of the radically polymerizable di-functional compounds having no charge transport structure include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacryalte, neopentylglycol diacrylate, binsphenol A-ethyleneoxy-modified diacrylate, bisphenol F-ethyleneoxy-modified diacrylate, and neopentylglycol diacryalte.

Specific examples of the radically polymerizable di-functional oligomers having no charge transport structure include epoxyacrylate oligomers, urethane acrylate oligomers, and polyester acrylate oligomers.

The content of a radically polymerizable difunctional compound or oligomer having no charge transport structure in the protective layer composition is generally not greater than 50% by weight, and preferably not greater than 30% by weight. When the content is greater than 50% by weight, the abrasion resistance of the resultant photoreceptor tends to deteriorate.

The protective layer composition preferably includes a filler, and preferably an inorganic filler to enhance the abrasion resistance of the resultant photoreceptor.

Specific examples of such an organic filler include powders of fluorine-containing resins such as polytetrafluoroethylene, and powders of silicone resins.

Specific examples of such an inorganic filler include powders of metals such as copper, tin, aluminum, and indium; powders of metal oxides such as silicon oxide, tin oxide, alumina, zinc oxide, titanium oxide, indium oxide, antimony oxide, and bismuth oxide; and powders of other inorganic materials such as potassium titanate, and amorphous carbon.

Among these inorganic fillers, metal oxide fillers are preferable, and silicon oxide fillers, aluminum oxide fillers, and titanium oxide fillers are more preferable. These fillers can be used alone or in combination.

Colloidal silica, and colloidal alumina can also be used as inorganic fillers.

The average primary particle diameter of the filler included in the protective layer composition is preferably from 0.01 μm to 0.5 μm. When the average primary particle diameter is less than 0.01 μm, the abrasion resistance of the resultant photoreceptor tends to deteriorate. When the average primary particle diameter is greater than 0.5 μm, the optical transmittance of the protective layer tends to deteriorate.

The content of a filler in the protective layer composition is generally from 5% to 50% by weight, and preferably from 5% to 30% by weight, based on the weight of the protective layer composition. When the content is less than 5% by weight, the abrasion resistance of the photoreceptor tends to deteriorate. When the content is greater than 50%, the irradiated-portion potential increasing problem tends to be caused, and the optical transmittance of the protective layer tends to deteriorate.

Metal oxide fillers subjected to a surface treatment using a surface treatment agent are preferably used because the fillers can be satisfactorily dispersed in the protective layer 13.

Specific examples of the surface treatment agent include titanate coupling agents, aluminum coupling agents, zircoaluminate coupling agents, and higher fatty acids. These can be used alone or in combination. In addition, combinations of one or more of silane coupling agents and one or more of the above-mentioned coupling agents can be used as the surface treatment agent.

The amount of a surface treatment agent used for such a surface treatment is generally from 3% to 30% by weight, and preferably from 5% to 20% by weight, based on the weight of the metal oxide to be treated. When the amount of a surface treatment agent is less than 3% by weight, the filler cannot be satisfactorily dispersed in the protective layer 13. When the amount is greater than 30% by weight, the irradiated-portion potential increasing problem tends to be caused.

The protective layer composition can further include a photopolymerization initiator.

Specific examples of such a photopolymerization initiator include acetophenone or ketal type photopolymerization initiators such as diethoxyacetophenone, 2,2-dimethoxy-1,2-diphenylethane-1-one, 1-hydroxycyclohexyl phenyl ketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-1-(4-methylthiophenyl)-2-morpholinopropane-1-one, and 1-phenyl-1,2-propanedione-2-(o-ethoxycarbonyl) oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acrylated benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, and imidazole compounds.

The amount of such a polymerization initiator for use in polymerizing a radically polymerizable compound in the protective layer composition is generally from 0.5% to 40% by weight, and preferably from 1% to 20% by weight, based on the weight of the radically polymerizable compound included in the protective layer composition.

The protective layer composition can further include a photopolymerization accelerator. Such a photopolymerization accelerator can be used alone or in combination with a photopolymerization initiator.

Specific examples of such a photopolymerization accelerator include triethanolamine, methyldiethanolamine, ethyl 4-dimethylaminobenzoate, isoamyl 4-dimethylaminobenzoate, 2-dimethylaminoethyl benzoate, and 4,4'-dimethylaminobenzophenone.

The protective layer composition can further include additives such as plasticizers, leveling agent, and charge transport materials.

Specific examples of the plasticizers include dibutyl phthalate, and dioctyl phthalate. The amount of such a plasticizer in the protective layer composition is generally not greater than 20% by weight, and preferably not greater than 10% by weight, based on the weight of the protective layer composition.

Specific examples of the leveling agent include silicone oils (such as dimethylsilicone oils, and methylphenylsilicone oils), and polymers and oligomers having a perfluoroalkyl group in their side chains. The amount of such a leveling agent in the protective layer composition is generally not greater than 3% by weight based on the weight of the protective layer composition.

The thickness of the protective layer is generally from 1 μm to 30 μm, preferably from 2 μm to 20 μm, and more preferably from 3 μm to 10 μm. When the thickness is less than 1 μm, the abrasion resistance of the protective layer cannot be satisfactorily improved. When the thickness is greater than 30 μm, the irradiated-portion potential increasing problem tends to be caused.

The protective layer 13 is typically prepared by a method including preparing a protective layer coating liquid in which the protective layer composition is dissolved or dispersed in an organic solvent; applying the coating liquid on the surface of the photosensitive layer with or without an intermediate layer therebetween; optionally drying the coated liquid; and then irradiating the coated liquid with activation energy rays to form a crosslinked protective layer.

The activation energy rays are not particularly limited, and for example ultraviolet rays, electron beams (accelerated electron beams), α rays, β rays, γ rays, X rays, and accelerated ions. Among these activation energy rays, ultraviolet rays, and electron beams are preferably used.

Specific examples of the organic solvent for use in the protective layer coating liquid include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated hydrocarbons such as dichloromethane, dichloroethane, trichloroethane, and chlorobenzene; aromatic solvents such as benzene, toluene, and xylene; and cellosolves such as methyl cellosolve, ethyl cellosolve, and cellosolve acetate. These solvents can be used alone or in combination.

The weight ratio (S/P) of the solvent (S) to the radically polymerizable compound (P) in the protective layer coating liquid is generally from 3 to 10.

Suitable methods for dissolving or dispersing the protective layer composition in an organic solvent include methods using a media such as ball mills, bead mills, sand mills, and vibration mills; and high speed collision-type dispersing methods. Suitable coating methods for use in coating the protective layer coating liquid include dip coating, spray coating, bead coating, and ring coating.

When the protective layer composition is subjected to a heat crosslinking treatment instead of a treatment using activation energy rays, it is hard to impart good abrasion resistance to the photoreceptor.

When the protective layer composition is irradiated with activation energy rays such as ultraviolet rays and electron beams, it is preferable that a nitrogen gas is supplied to reduce the concentration of oxygen in the atmosphere, and cooling is performed to prevent increase of temperature of the photoreceptor.

Specific examples of the light source emitting ultraviolet rays used for crosslinking the protective layer composition include high pressure mercury lamps, and metal halide lamps.

The intensity of light is preferably from 50 $mW/cm^2$ to 1,000 $mW/cm^2$. When the light intensity is less than 50 $mW/cm^2$, it takes a time for crosslinking the protective layer composition. When the light intensity is greater than 1,000 $mW/cm^2$, the irradiated-portion potential increasing problem tends to be caused.

It is preferable that after the protective layer composition is crosslinked using ultraviolet rays, the protective layer (photoreceptor) is heated for 10 to 30 minutes at a temperature of from 100 to 150° C. to reduce the amount of the solvent remaining in the protective layer.

When the protective layer composition is crosslinked by electron beams, the conditions are described, for example, in JP-2004-212959-A incorporated herein by reference.

In an electron beam crosslinking treatment, the acceleration voltage is generally not higher than 250 kV, the radiation dose is generally from 1 to 20 Mrad, and the concentration of oxygen in the atmosphere is generally not higher than 10,000 ppm.

Next, the charge generation layer 12*a* of the photoreceptor will be described.

The charge generation layer 12*a* includes at least a charge generation material, and optionally includes a binder resin.

Inorganic charge generation materials and organic charge generation materials can be used as the charge generation material.

Specific examples of such inorganic charge generation materials include crystalline selenium, amorphous selenium, selenium-tellurium compounds, selenium-tellurium-halogen compounds, and selenium-arsenic compound.

Specific examples of such organic charge generation materials include phthalocyanine pigments such as metal phthalocyanine and metal-free phthalocyanine; azulenium salt type pigments; squaric acid methyne pigments; azo pigments having a carbazole skeleton; azo pigments having a triphenyl amine skeleton; azo pigments having a diphenyl amine skeleton; azo pigments having a dibenzothiophene skeleton; azo pigments having a fluorenone skeleton; azo pigments having an oxadiazole skeleton; azo pigments having a bisstilbene skeleton; azo pigments having a distyryloxadiazole skeleton; azo pigments having a distyrylcarbazole skeleton; perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, and bisbenzimidazole pigments. These are used alone or in combination.

Specific examples of the binder resin, which is optionally included in the charge generation layer, include polyamide, polyurethane, epoxy resins, polyketone, polycarbonate, silicone resins, acrylic resins, polyvinyl butyral, polyvinyl formal, polyvinyl ketone, polystyrene, and polyacrylamide. These resins can be used alone or in combination.

The charge generation layer 12*a* can further include a charge transport material or a charge transport polymer.

The thickness of the charge generation layer 12*a* is generally from 0.01 μm to 5 μm, and preferably from 0.05 μm to 2 μm.

The charge generation layer 12*a* can be prepared by a vacuum thin film forming method such as glow discharge polymerization methods, vacuum evaporation methods, CVD (chemical vapor deposition) methods, sputtering methods, reaction sputtering methods, ion plating methods, and accelerated ion injection methods.

The charge generation layer 12*a* can also be prepared by a method including preparing a coating liquid by dissolving or dispersing a charge generation material and an optional binder resin in an organic solvent; applying the coating liquid on the electroconductive substrate 11 with or without an intermediate layer therebetween, and then drying the coated liquid to form the charge generation layer.

Specific examples of the solvent for use in the charge generation layer coating liquid include acetone, methyl ethyl ketone, methyl isobutyl ketone, cyclohexanone, benzene, toluene, xylene, chloroform, dichloromethane, dichloroethane, dichloropropane, trichloroethane, trichloroethylene, tetrachloroethane, tetrahydrofuran, dioxolan, dioxane, methanol, ethanol, isopropyl alcohol, butanol, ethyl acetate, butyl acetate, dimethylsulfoxide, methyl cellosolve, ethyl cellosolve, and propyl cellosolve.

Among these solvents, tetrahydrofuran, methyl ethyl ketone, dichloromethane, methanol, and ethanol are preferable.

Suitable methods for dissolving or dispersing a charge generation material and an optional binder resin in an organic solvent include methods using a media such as ball mills, bead mills, sand mills, and vibration mills; and high speed collision-type dispersing methods, but are not limited thereto. Suitable coating methods for use in coating the charge generation layer coating liquid include dip coating, spray coating, and bead coating.

Next, the charge transport layer 12*b* will be described.

The charge transport layer includes a charge transport material and a binder resin.

Positive hole transport materials and electron transport materials can be used as the charge transport material.

Specific examples of such positive hole transport materials include oxazole derivatives, oxadiazole derivatives, imidazole derivatives, triphenylamine derivatives, 9-(p-diethylaminostyrylanthracene) derivatives, 1,1-bis(4-dibenzylaminophenyl)propane, styrylanthracene, styryl pyrazoline, phenyl hydrazone compounds, α-phenylstilbene derivatives, thiazole derivatives, triazole derivatives, phenazine derivatives, acridine derivatives, benzofuran derivatives, benzimidazole derivatives, and thiophene derivatives. These positive hole transport materials can be used alone or in combination.

Specific examples of such electron transport materials include fluorenone compounds such as trinitrofluorenone, and fluorenylidenemethane derivatives; and quinone compounds such as diphenoquinone, and anthraquinone derivatives. These electron transport materials can be used alone or in combination.

The charge transport layer 12*b* can further include a charge transport polymer.

Suitable charge transport polymers include polymers having a carbazole ring, polymers having a hydrazone structure, polysilylene compounds, polymers having a triarylamine structure, and polymers having other charge transport structures.

Specific examples of the polymers having a carbazole ring include polyvinyl carbazole, and compounds listed in JP-S50-082056-A, JP-S54-009632-A, JP-S54-011737-A, JP-H04-175337-A, JP-H04-183719-A and JP-H06-234841-A.

Specific examples of the polymers having a hydrazone structure include the compounds listed in JP-S57-078402-A, JP-S61-020953-A, JP-S61-296358-A, JP-S01-134456-A, JP-S01-179164-A, JP-H03-180851-A, JP-H03-180852-A, JP-H03-050555-A, JP-H05-310904-A and JP-H06-234840-A.

Specific examples of the polysilylene compounds include the compounds listed in JP-S63-285552-A, JP-H01-088461-A, JP-H04-264130-A, JP-H04-264131-A, JP-H04-264132-A, JP-H04-264133-A and JP-H04-289867-A.

Specific examples of the polymers having a triarylamine structure include N,N-bis(4-methylphenyl)-4-aminopolystyrene, and compounds listed in JP-H01-134457-A, JP-H02-282264-A, JP-H02-304456-A, JP-H04-133065-A, JP-H04-133066-A, JP-H05-040350-A and JP-H05-202135-A.

Specific examples of the polymers having other charge transport structures include nitropyrene-formaldehyde condensation polymers and compounds listed in JP-S51-073888-A, JP-S56-150749-A, JP-H06-234836-A and JP-H06-234837-A.

In addition, polycarbonate resins, polyurethane resins, polyester resins and polyether resins, each of which has a triarylamine structure, can also be used as charge transport polymers. Specific examples thereof include compounds listed in JP-S64-001728-A, JP-S64-013061-A, JP-S64-019049-A, JP-H04-011627-A, JP-H04-225014-A, JP-H04-230767-A, JP-H04-320420-A, JP-H05-232727-A, JP-H07-056374-A, JP-H09-127713-A, JP-H09-222740-A, JP-H09-265197-A, JP-H09-211877-A and JP-H09-304956-A.

Further, copolymers (such as block copolymers, and graft copolymers) and star polymers of the above-mentioned polymers with known monomers, and crosslinked polymers having a positive hole transport structure and disclosed in JP-H03-109406-A can also be used as polymers having a positive hole transport structure.

Specific examples of the binder resins included in the charge transport layer include, but are not limited thereto, polycarbonate resins, polyester resins, methacrylic resins, acrylic resins, polyethylene resins, polyvinyl chloride resins, polyvinyl acetate resins, polystyrene resins, phenolic resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins, and phenoxy resins. These resins can be used alone or in combination.

The charge transport layer 12*b* can be prepared using a composition including a copolymer of a binder resin having a crosslinking ability and a charge transport material having a crosslinking ability.

The charge transport layer 12*b* can further include other components such as plasticizers and leveling agents.

The thickness of the charge transport layer 12*b* is generally from 5 μm to 100 μm, and preferably from 5 μm to 30 μm.

The charge transport layer 12*b* is typically prepared by a method including preparing a coating liquid by dissolving or dispersing a charge transport material and a binder resin in an organic solvent; applying the coating liquid on the charge generation layer 12*a*; and drying the coated liquid.

Specific examples of the organic solvent for use in preparing the charge transport layer coating liquid include acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofuran, dioxolan, dioxane, methanol, ethanol, isopropyl alcohol, butanol, ethyl acetate, butyl acetate, dimethylsulfoxide, methyl cellosolve, ethyl cellosolve, and propyl cellosolve. These solvents can be used alone or in combination.

Among these organic solvents, tetrahydrofuran, methyl ethyl ketone, dichloromethane, methanol and ethanol are preferable.

Specific examples of the method of dissolving or dispersing a charge transport material and a binder resin in an organic solvent include methods using a media such as ball mills, bead mills, sand mills, and vibration mills; and high speed collision methods.

Specific examples of the method of applying the charge transport layer coating liquid include dip coating methods, spray coating methods, and bead coating methods, but are not limited thereto.

Next, the electroconductive substrate 11 of the photoreceptor will be described.

Suitable materials for use as the electroconductive substrate include materials having a volume resistivity not greater than $1\times10^{10}$ Ω·cm. Specific examples of such materials include plastic cylinders, plastic films or paper sheets, on the surface of which a layer of a metal such as aluminum, nickel, chromium, nichrome, copper, gold, silver, and platinum, or a metal oxide such as tin oxides, and indium oxides, is formed using a deposition or sputtering method. In addition, a plate of a metal such as aluminum, aluminum alloys, nickel and stainless steel can be used as the electroconductive substrate. Metal cylinders, which are prepared by tubing a metal such as aluminum, aluminum alloys, nickel and stainless steel by a method such as impact ironing or direct ironing, and then subjecting the surface of the tube to cutting, super finishing, polishing and the like treatments, can also be used as the electroconductive substrate. Further, endless belts of a metal such as nickel, and stainless steel, which is disclosed, for example, in JP-S52-36016-A, can also be used as the electroconductive substrate. In addition, nickel films having a thickness of 50 μm to 150 μm, and polyethylene terephthalate films, which have a thickness of 50 μm to 150 μm, on which an aluminum layer is formed by a deposition method can also be used as the electroconductive substrate.

Furthermore, substrates, in which an electroconductive layer including a binder resin and an electroconductive powder is formed on a substrate, can be used as the electroconductive substrate. Specific examples of such an electroconductive powder include carbon black, acetylene black, powders of metals such as aluminum, nickel, iron, nichrome, copper, zinc, and silver, and metal oxides such as electroconductive tin oxides, and ITO.

Specific examples of the binder resin for use in the electroconductive layer include known thermoplastic resins, thermosetting resins and photo-crosslinking resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, and alkyd resins.

Such an electroconductive layer can be formed by coating a coating liquid in which an electroconductive powder and a binder resin are dispersed or dissolved in a proper organic solvent such as tetrahydrofuran, dichloromethane, methyl ethyl ketone, and toluene, and then drying the coated liquid.

Specific examples of the method of dissolving or dispersing an electroconductive powder and a binder resin in an organic solvent include methods using a media such as ball mills, bead mills, sand mills, and vibration mills; and high speed collision methods.

Specific examples of the method of applying the electroconductive layer coating liquid include dip coating methods, spray coating methods, and bead coating methods, but are not limited thereto.

Further, cylindrical substrates covered with a heat-shrinking tube in which a particulate electroconductive material is dispersed can also be used as the electroconductive substrate 11.

Specific examples of the resin constituting the heat-shrinking tube include polyvinyl chloride, polypropylene, polyester, polystyrene, polyvinylidene chloride, polyethylene, chlorinated rubbers, and TEFLON.

Figure 2:
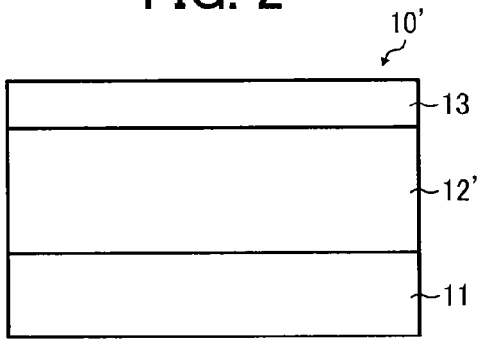
FIG. 2 is a schematic cross-sectional view illustrating another example of the photoreceptor of the present invention.

Another example of the photoreceptor of the present invention is illustrated in FIG. 2. The photoreceptor 10' illustrated in FIG. 2 has the same structure as that of the photoreceptor 10 illustrated in FIG. 1 except that a single-layered photosensitive layer 12' is formed instead of the layered photosensitive layer 12.

The photosensitive layer 12' is the same as the charge transport layer 12*b* except that the photosensitive layer 12' further includes a charge generation material such as those mentioned above for use in the charge generation layer 12*a*.

The thickness of the photosensitive layer 12' is generally from 5 μm to 100 μm, and preferably from 5 μm to 50 μm. When the thickness is less than 5 μm, the charging property of the photoreceptor tends to deteriorate. When the thickness is greater than 100 μm, the photosensitivity of the photoreceptor tends to deteriorate.

Figure 3:
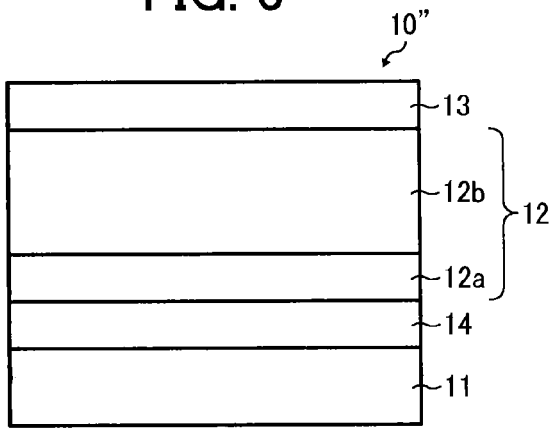
FIG. 3 is a schematic cross-sectional view illustrating yet another example of the photoreceptor of the present invention.

Yet another example of the photoreceptor of the present invention is illustrated in FIG. 3. The photoreceptor 10" illustrated in FIG. 3 has the same structure as that of the photoreceptor 10 illustrated in FIG. 1 except that an undercoat layer 14 is formed between the electroconductive substrate 11 and the photosensitive layer 12.

The undercoat layer 14 includes a resin as a main component. Specific examples of such a resin include water-soluble resins such as polyvinyl alcohol, casein and sodium salts of polyacrylic acid; alcohol soluble resins such as nylon copolymers and methoxymethylated nylons; and thermosetting resins capable of forming a three-dimensional network such as polyurethane resins, melamine resins, alkyd-melamine resins, and epoxy resins.

The undercoat layer can further include a filler such as particulate metal oxides, particulate metal sulfides, and particulate metal nitrides. Specific examples of such metal oxides include titanium oxide, silica, alumina, zirconium oxide, tin oxide, and indium oxide.

The thickness of the undercoat layer is generally from 0.1 μm to 10 μm, and preferably from 1 μm to 5 μm.

The undercoat layer 14 can be formed, for example, by a method including applying a coating liquid, which is prepared by dissolving a resin in a solvent, on the electroconductive substrate 11, and then drying the coated liquid.

The undercoat layer 14 can be formed by subjecting the electroconductive substrate 11 having a metal oxide thereon to a surface treatment using a silane coupling agent, a titanium coupling agent, a chromium coupling agent, or the like.

In addition, a metal oxide layer prepared by a sol-gel method, an aluminum oxide layer which is formed by subjecting an electroconductive material including aluminum therein to anodic oxidation, and a layer of an organic compound (such as polyparaxylylene) or an inorganic compound such as SiO, $SnO_2$, $TiO_2$, ITO or $CeO_2$, which layer is formed by a vacuum evaporation method, can also be used as the undercoat layer.

Each of the photosensitive layer 12', the protective layer 13, the charge transport layer 12*b*, the charge generation layer 12*a*, and the undercoat layer 14 can further include an antioxidant to prevent deterioration of the photosensitivity of the resultant photoreceptor and to prevent occurrence of the irradiated-portion potential increasing problem.

Figure 4:
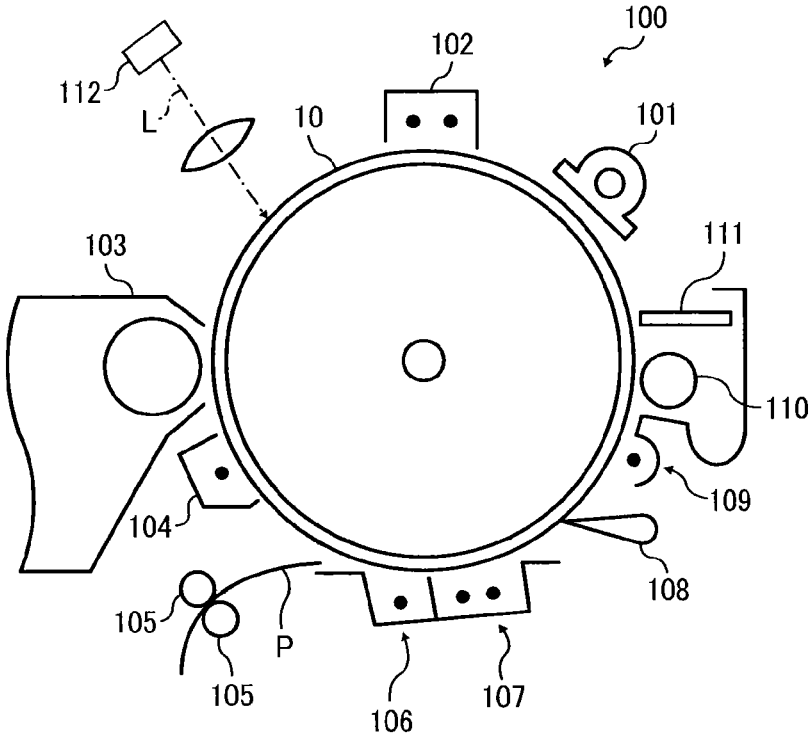
FIG. 4 is a schematic view illustrating an example of the image forming apparatus of the present invention.

FIG. 4 illustrates an example of the image forming apparatus of the present invention. Referring to FIG. 4, an image forming apparatus 100 includes a photoreceptor 10, which is the photoreceptor of the present invention and which has a drum-shape and is rotated counterclockwise.

Hereinafter, the image forming method of the image forming apparatus 100 will be described by reference to FIG. 4. Initially, the surface of the photoreceptor 10 is subjected to a discharge treatment using a discharge lamp 101. Thereafter, the surface of the photoreceptor 10 is charged with a corona charger 102. The charged surface of the photoreceptor 10 is irradiated with light L emitted by an irradiator 112 to form an electrostatic latent image thereon. The electrostatic latent image is developed by a developing device 103 using a toner, thereby forming a toner image on the surface of the photoreceptor 10. After the toner image on the photoreceptor 10 is charged by a pre-transfer charger 104, the toner image is transferred onto a recording paper P, which is fed by a pair of registration rollers 105, by a transfer charger 106. After the recording paper P bearing the toner image thereon is charged by a separation charger 107, the recording paper P is separated from the photoreceptor 10 by a separation pick 108. Meanwhile, residual toner particles, which remain on the surface of the photoreceptor 10 even after the toner image is transferred, are charged by a pre-cleaning charger 109, and then removed from the surface of the photoreceptor 10 by a cleaning brush 110 and a cleaning blade 111 so that the photoreceptor 10 is ready for the next image forming operation.

Suitable light sources for use in the discharge lamp 101 and the irradiator 112 include fluorescent lamps, tungsten lamps, halogen lamps, mercury lamps, sodium lamps, light emitting diodes (LEDs), laser diodes (LDs), and light sources using electroluminescence (EL). In this regard, in order to obtain light having a desired wave length range, filters such as sharp-cut filters, band pass filters, near-infrared cutting filters, dichroic filters, interference filters, and color temperature converting filters can be used.

Chargers such as corotrons and scorotrons can be used for the corona charger 102.

Chargers such as corotrons, scorotrons, solid state chargers, and charging rollers can be used for the pre-transfer charger 104, the transfer charger 106, the separation charger 107, and the pre-cleaning charger 109.

Specific examples of the brush for use as the cleaning brush 110 include fur brushes and mag-fur brushes.

Specific examples of the material of the cleaning blade 111 include urethane resins, silicone resins, fluorine-containing resins, urethane elastomers, silicone elastomers, fluorine-containing elastomers. Among these materials, urethane elastomers are preferable from the viewpoint of abrasion resistance, resistance to ozone, and resistance to staining.

The hardness (JIS-A hardness) of the cleaning blade 111 is generally from 65° to 850. The thickness of the cleaning blade 111 is generally from 0.8 mm to 3.0 mm. The length of a portion of the cleaning blade 111 extending from the tip of a holder thereof is generally from 3 to 15 mm.

Known toners such as toners, which include toner particles including a binder resin and a colorant, and an external additive such as fluidity improving agents, can be used for the toner. In this regard, the toner particles can further include therein additives such as release agents and charge controlling agents.

Figure 5:
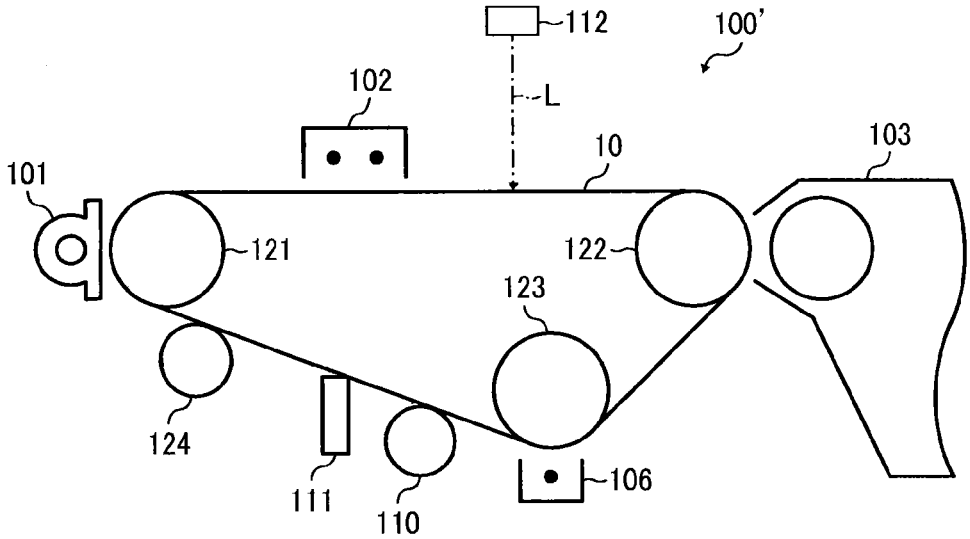
FIG. 5 is a schematic view illustrating another example of the image forming apparatus of the present invention.

FIG. 5 illustrates another example of the image forming apparatus of the present invention. An image forming apparatus 100' illustrated in FIG. 5 includes the photoreceptor 10, which is the photoreceptor of the present invention and which has a belt-shape. The belt-shaped photoreceptor 10 is supported by a driving roller 121, driven rollers 122 and 123, and is rotated clockwise by the driving roller 121.

Hereinafter, the image forming method of the image forming apparatus 100' will be described by reference to FIG. 5. Initially, the surface of the belt-shaped photoreceptor 10 is subjected to a discharge treatment using the discharge lamp 101. Thereafter, the surface of the photoreceptor 10 is charged with the corona charger 102. The charged surface of the photoreceptor 10 is irradiated with light L emitted by the irradiator 112 to form an electrostatic latent image thereon. The electrostatic latent image is developed by the developing device 103 using a toner, thereby forming a toner image on the surface of the photoreceptor 10. After the toner image on the photoreceptor 10 is transferred onto a recording paper (not shown) by the transfer charger 106, residual toner particles, which remain on the surface of the photoreceptor 10 even after the toner image is transferred, are removed therefrom by the cleaning brush 110 and the cleaning blade 111 so that the photoreceptor 10 is ready for the next image forming operation. In addition, the surface of the photoreceptor 10 is cleaned by a cleaning brush 124 to remove residual toner particles remaining on the photoreceptor even after the first cleaning operation. In this regard, the cleaning brush 124 has substantially the same configuration as the cleaning brush 110.

Figure 6:
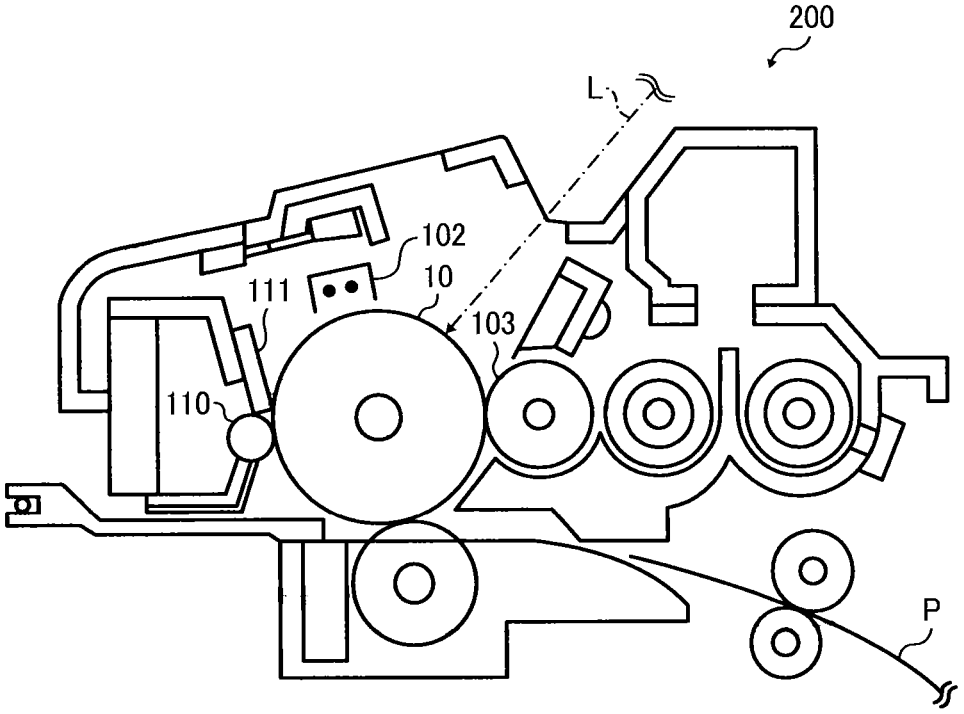
FIG. 6 is a schematic view illustrating an example of the process cartridge of the present invention.

FIG. 6 illustrates an example of the process cartridge of the present invention. A process cartridge 200 illustrated in FIG. 6 includes the photoreceptor which is the photoreceptor of the present invention, the corona charger 102, the developing device 103, the cleaning brush 110, and the cleaning blade 111. The photoreceptor 10 and the devices are integrated as a single unit so as to be detachably attachable to an image forming apparatus.

The process cartridge of the present invention includes at least the photoreceptor of the present invention, and a charger to subject a surface of the photoreceptor to corona charging.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Undercoat Layer

The following components were mixed and the mixture was subjected to a dispersing treatment to prepare an undercoat layer coating liquid.

| | |
|---|---|
| Titanium oxide<br>(CR-EL from Ishihara Sangyo Kaisha K.K.) | 40 parts |
| Alkyd resin<br>(BEKKOLITE M6401-50 from DIC Corp., solid content of 50%) | 6 parts |
| Melamine resin<br>(SUPER BEKKAMINE G-821-60 from DIC Corp., solid content of 60%) | 4 parts |
| Methyl ethyl ketone | 50 parts |

The undercoat layer coating liquid was applied on a circumferential surface of an aluminum cylinder having an outer diameter of 100 mm by a dip coating method, and the coated liquid was dried for 20 minutes in an oven heated to 130° C. Thus, an undercoat layer having a thickness of 3.5 μm was prepared.

(Preparation of Charge Generation Layer)

The following components were mixed to prepare a charge generation layer coating liquid.

| | |
|---|---|
| Y-form titanyl phthalocyanine | 6 parts |
| Butyral resin<br>(S-LEC BX-1 from Sekisui Chemical Co., Ltd.) | 4 parts |
| Methyl ethyl ketone | 200 parts |

The charge generation layer coating liquid was applied on the undercoat layer by a dip coating method, and the coated liquid was dried for 20 minutes in an oven heated to 130° C. Thus, a charge generation layer having a thickness of 0.2 μm was prepared.

(Preparation of Charge Transport Layer)

The following components were mixed to prepare a charge transport layer coating liquid.

| | |
|---|---|
| Bisphenol Z-form polycarbonate | 10 parts |
| Charge transport material having the following formula (A) | 10 parts |

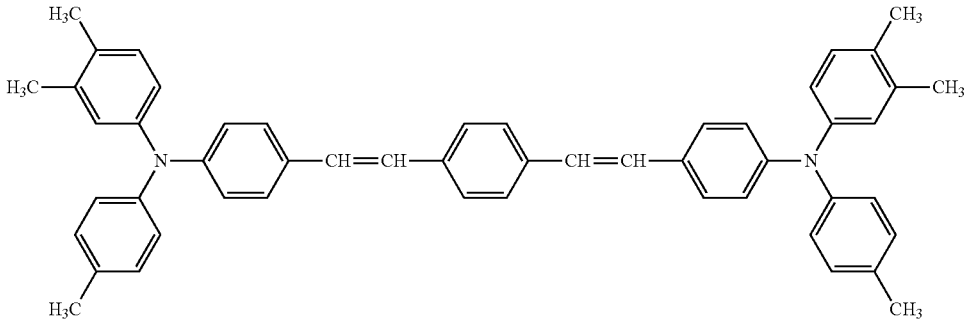

(A)

| | |
|---|---|
| Tetrahydrofuran | 80 parts |

The charge transport layer coating liquid was applied on the charge generation layer by a dip coating method, and the coated liquid was dried for 20 minutes in an oven heated to 135° C. Thus, a charge transport layer having a thickness of 22 μm was prepared.

(Preparation of Protective Layer)

The following components were mixed to prepare a protective layer coating liquid.

| | |
|---|---|
| Compound having the formula (1-1) mentioned above (i.e., SR349 from Sartomer) | 10 parts |
| Radically polymerizable monofunctional compound having a charge transport structure having the following formula (B) | 10 parts |

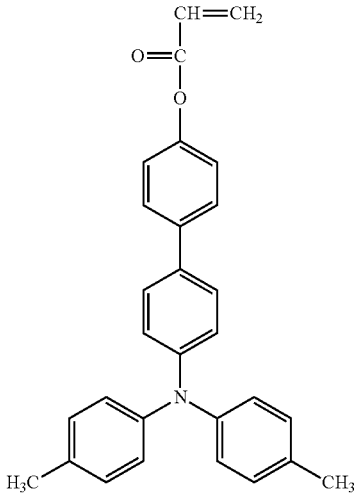

(B)

| | |
|---|---|
| Compound having the formula (2-1) mentioned above | 0.5 parts |
| 1-Hydroxycyclohexyl phenyl ketone (photopolymerization initiator, IRGACURE 184 from Ciba Specialty Chemicals) | 1 part |
| Tetrahydrofuran | 100 parts |

The protective layer coating liquid was applied on the charge transport layer by a spray coating method, and the coated liquid was allowed to settle for 10 minutes under a nitrogen gas flow so that the coated liquid was dried to an extent such that the resultant layer is not damaged when a finger is contacted therewith. Next, the electroconductive substrate bearing the undercoat layer, the charge generation layer, the charge transport layer, and the dried protective layer was set in a chamber in which the air is substituted with a nitrogen gas so that the oxygen content is not greater than 2%, and the dried protective layer coating liquid was irradiated with ultraviolet rays under the following conditions.

Light source: metal halide lamp with a power of 160 W/cm

Distance between light source and coated layer: 120 mm

Intensity of light: 700 mW/cm$^2$

Irradiation time: 80 seconds

Further, the electroconductive substrate bearing the layers thereon was heated for 20 minutes at 130° C. to form a protective layer having a thickness of 8 μm as an outermost layer.

Thus, a photoreceptor of Example 1 was prepared.

Example 2

The procedure for preparation of the photoreceptor of Example 1 was repeated except that the compound having formula (2-1) used for the protective layer coating liquid was replaced with the compound having the formula (2-4) mentioned above to prepare a photoreceptor of Example 2.

Example 3

The procedure for preparation of the photoreceptor of Example 1 was repeated except that the compound having formula (2-1) used for the protective layer coating liquid was replaced with the compound having the formula (2-6) mentioned above to prepare a photoreceptor of Example 3.

Example 4

The procedure for preparation of the photoreceptor of Example 1 was repeated except that the compound having formula (1-1) used for the protective layer coating liquid was replaced with the compound having the formula (1-2) mentioned above (i.e., SR348 from Sartomer) to prepare a photoreceptor of Example 4.

Example 5

The procedure for preparation of the photoreceptor of Example 1 was repeated except that the compound having formula (2-1) used for the protective layer coating liquid was replaced with the compound having the formula (3-1) mentioned above to prepare a photoreceptor of Example 5.

Example 6

The procedure for preparation of the photoreceptor of Example 1 was repeated except that the compound having formula (2-1) used for the protective layer coating liquid was replaced with the compound having the formula (3-3) mentioned above to prepare a photoreceptor of Example 6.

Example 7

The procedure for preparation of the photoreceptor of Example 1 was repeated except that the compound having formula (1-1) and the compound having formula (2-1) used for the protective layer coating liquid were respectively replaced with the compound having the formula (1-3) mentioned above (i.e., SR601 from Sartomer) and the compound having the formula (2-2) mentioned above to prepare a photoreceptor of Example 7.

Example 8

The procedure for preparation of the photoreceptor of Example 1 was repeated except that the compound having formula (1-1) and the compound having formula (2-1) used for the protective layer coating liquid were respectively replaced with the compound having the formula (1-4) mentioned above (i.e., SR602 from Sartomer) and the compound having the formula (2-9) mentioned above to prepare a photoreceptor of Example 8.

Example 9

The procedure for preparation of the photoreceptor of Example 1 was repeated except that the added amount of the compound having formula (2-1) was changed to 0.3 parts to prepare a photoreceptor of Example 9.

Example 10

The procedure for preparation of the photoreceptor of Example 1 was repeated except that the added amount of the compound having formula (2-1) was changed to 1 part to prepare a photoreceptor of Example 10.

Example 11

The procedure for preparation of the photoreceptor of Example 1 was repeated except that the added amount of the compound having formula (2-1) was changed to 5 parts to prepare a photoreceptor of Example 11.

Example 12

The procedure for preparation of the photoreceptor of Example 1 was repeated except that the added amount of the compound having formula (2-1) was changed to 10 parts to prepare a photoreceptor of Example 12.

Example 13

The procedure for preparation of the photoreceptor of Example 1 was repeated except that the added amount of the compound having formula (2-1) was changed to 15 parts to prepare a photoreceptor of Example 13.

Example 14

The procedure for preparation of the photoreceptor of Example 3 was repeated except that the radically polymerizable monofunctional compound having a charge transport structure, which has formula (B), was replaced with a radically polymerizable monofunctional compound having a charge transport structure, which has the following formula (C), to prepare a photoreceptor of Example 14.

(C)

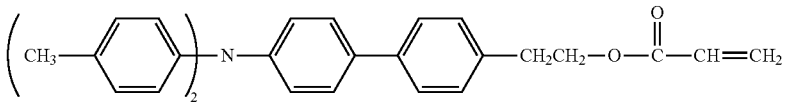

Example 15

The procedure for preparation of the photoreceptor of Example 1 was repeated except that 2 parts of the compound having formula (1-1) (i.e., SR349 from Sartomer) was replaced with 2 parts of a radically polymerizable tetrafunctional compound having no charge transport structure, which has the following formula (D) and which is SR355 from Sartomer, to prepare a photoreceptor of Example 15.

(D)

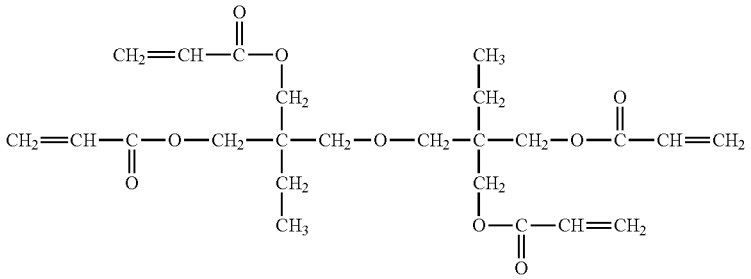

Example 16

The procedure for preparation of the photoreceptor of Example 1 was repeated except that 4 parts of the compound having formula (1-1) (i.e., SR349 from Sartomer) was replaced with 4 parts of the radically polymerizable tetrafunctional compound having no charge transport structure, which has formula (D) (i.e., SR355 from Sartomer), to prepare a photoreceptor of Example 16.

Example 17

The procedure for preparation of the photoreceptor of Example 15 was repeated except that the compound having formula (1-1) was replaced with the compound having the formula (1-2) mentioned above (i.e., SR348 from Sartomer) to prepare a photoreceptor of Example 17.

Example 18

The procedure for preparation of the photoreceptor of Example 6 was repeated except that 4 parts of the compound having formula (1-1) (i.e., SR349 from Sartomer) was replaced with 4 parts of a radically polymerizable tetrafunctional compound having no charge transport structure, which has the following formula (E) and which is A-TMMT from Shin-Nakamura Chemical Co., Ltd., to prepare a photoreceptor of Example 18.

(E)

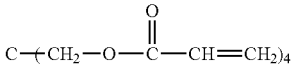

Example 19

The procedure for preparation of the photoreceptor of Example 18 was repeated except that the compound having formula (1-1) was replaced with the compound having the formula (1-3) mentioned above (i.e., SR601 from Sartomer) to prepare a photoreceptor of Example 19.

Example 20

The procedure for preparation of the photoreceptor of Example 4 was repeated except that 2 parts of the compound having formula (1-2) (i.e., SR348 from Sartomer) was replaced with 2 parts of a radically polymerizable hexafunctional compound having no charge transport structure, which is an urethane acrylate U-6HA from Shin-Nakamura Chemical Co., Ltd., to prepare a photoreceptor of Example 20.

Example 21

The procedure for preparation of the photoreceptor of Example 7 was repeated except that 2 parts of the compound having formula (1-3) (i.e., SR601 from Sartomer) was replaced with 2 parts of a radically polymerizable trifunctional compound having no charge transport structure, which has the following formula (F) (i.e., SR368 from Sartomer), to prepare a photoreceptor of Example 21.

(F)

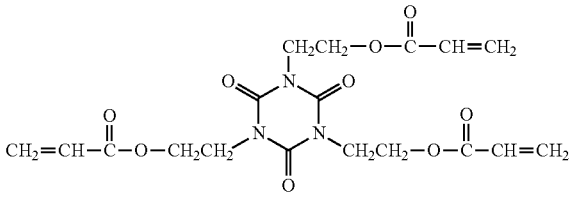

Example 22

The procedure for preparation of the photoreceptor of Example 1 was repeated except that the protective layer coating liquid was replaced with a protective layer coating liquid prepared by the following method, the irradiation time of ultraviolet rays was changed to 100 seconds, and the thickness of the protective layer was changed to 4 μm.

(Preparation of the Protective Layer Coating Liquid)

The following components were mixed, and the mixture was subjected to a dispersing treatment to prepare a protective layer coating liquid.

| | |
|---|---|
| Compound having formula (1-1) | 10 parts |
| Radically polymerizable monofunctional compound having a charge transport structure and having formula (C) mentioned above | 10 parts |
| Compound having the formula (2-6) mentioned above | 0.5 parts |
| Particulate alumina serving as a filler (AA-03 from Sumitomo Chemical Co., Ltd. having an average primary particle diameter of 0.3 μm) | 3 parts |
| Polymer of unsaturated polycarboxylic acid (BYK-P104 from BYK Chemie GmbH) | 0.06 parts |
| 1-Hydroxycyclohexyl phenyl ketone (photopolymerization initiator, IRGACURE 184 from Ciba Specialty Chemicals) | 1 part |
| Tetrahydrofuran | 100 parts |

Thus, a photoreceptor of Example 22 was prepared.

Example 23

The procedure for preparation of the photoreceptor of Example 22 was repeated except that the particulate alumina AA-03 used for the protective layer coating liquid was replaced with a particulate silica (KMPX100 from Shin-Etsu Chemical Co., Ltd.) which has an average primary particle diameter of 0.1 μm to prepare a photoreceptor of Example 23.

Example 24

The procedure for preparation of the photoreceptor of Example 22 was repeated except that the particulate alumina AA-03 used for the protective layer coating liquid was replaced with a particulate titanium oxide (CR-97 from Ishihara Sangyo Kaisha Ltd.) which has an average primary particle diameter of 0.25 μm to prepare a photoreceptor of Example 24.

Example 25

The procedure for preparation of the photoreceptor of Example 22 was repeated except that the particulate alumina AA-03 used for the protective layer coating liquid was replaced with a particulate polytetrafluoroethylene (PTFE) from Du Pont-Mitsui Fluorochemicals Co., Ltd. which has an average primary particle diameter of 0.25 m to prepare a photoreceptor of Example 25.

Comparative Example 1

The procedure for preparation of the photoreceptor of Example 1 was repeated except that the compound having formula (2-1) was not included in the protective layer coating liquid to prepare a photoreceptor of Comparative Example 1.

Comparative Example 2

The procedure for preparation of the photoreceptor of Comparative Example 1 was repeated except that the compound having formula (1-1) was replaced with the compound having the formula (1-3) mentioned above to prepare a photoreceptor of Comparative Example 2.

Comparative Example 3

The procedure for preparation of the photoreceptor of Comparative Example 1 was repeated except that the compound having formula (1-1) was replaced with the compound having the formula (1-4) mentioned above to prepare a photoreceptor of Comparative Example 3.

Comparative Example 4

The procedure for preparation of the photoreceptor of Example 1 was repeated except that the compound having formula (2-1) was replaced with a compound, which is an ultraviolet absorbent and has the following formula (G), to prepare a photoreceptor of Comparative Example 4.

(G)

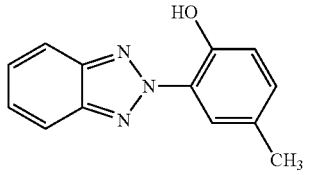

Comparative Example 5

The procedure for preparation of the photoreceptor of Example 1 was repeated except that the compound having formula (2-1) was replaced with a compound, which is an ultraviolet absorbent and has the following formula (H), to prepare a photoreceptor of Comparative Example 5.

(H)

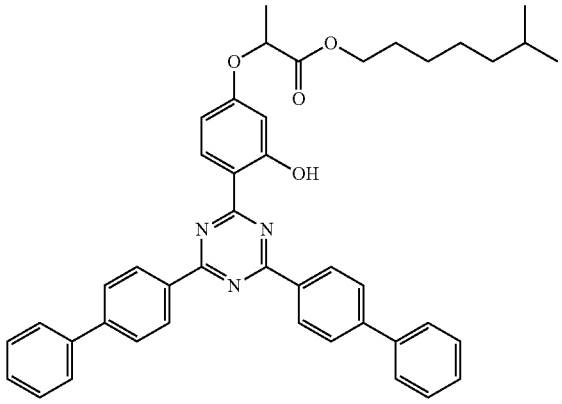

Comparative Example 6

The procedure for preparation of the photoreceptor of Example 1 was repeated except that the compound having formula (1-1) was replaced with the radically polymerizable tetrafunctional compound having no charge transport structure and having formula (D) (i.e., SR355 from Sartomer) to prepare a photoreceptor of Comparative Example 6.

Comparative Example 7

The procedure for preparation of the photoreceptor of Example 2 was repeated except that the compound having formula (1-1) was replaced with the radically polymerizable tetrafunctional compound having no charge transport structure and having formula (E) (i.e., A-TMMT from Shin-Nakamura Chemical Co., Ltd.) to prepare a photoreceptor of Comparative Example 7.

Comparative Example 8

The procedure for preparation of the photoreceptor of Example 2 was repeated except that the compound having formula (1-1) was replaced with the radically polymerizable hexafunctional compound having no charge transport structure (i.e., urethane acrylate U-6HA from Shin-Nakamura Chemical Co., Ltd.) to prepare a photoreceptor of Comparative Example 8.

Comparative Example 9

The procedure for preparation of the photoreceptor of Example 22 was repeated except that the compound having formula (1-1) was replaced with the radically polymerizable trifunctional compound having no charge transport structure and having formula (F) (i.e., SR368 from Sartomer) to prepare a photoreceptor of Comparative Example 9.

The photoreceptors of Examples 1-25 and Comparative Example 1-9 were evaluated with respect to the following properties.

1. Potential of Irradiated Portions of the Photoreceptors

A photoreceptor was set in a black image forming station of a modified full color printer PRO C900 from Ricoh Co., Ltd., which uses a corona charger for charging the circumferential surface of the photoreceptor, which charger had been used (i.e., discharged) for 200 hours or more, and a running test in which 200,000 copies of an A-4 size half-tone test chart including only black half-tone images having an image area proportion of 5% are produced was performed. After the running test, 50 copies of a black solid image were continuously produced. When the last five copies (i.e., five copies of from the $46^{th}$ image to the $50^{th}$ image) were produced, the potentials of the irradiated portions of the photoreceptor were measured, and the potentials were averaged to determine the potential of irradiated portions of the photoreceptor.

2. Evenness of Image Density of Images Produced by the Photoreceptors

A photoreceptor was set in the black image forming station of the modified full color printer PRO C900 from Ricoh Co., Ltd., which uses a corona charger for charging the circumferential surface of the photoreceptor, which charger had been used (i.e., discharged) for 200 hours or more, and a running test in which 20,000 copies of a half-tone test chart including only black half-tone images having an image area proportion of 5% are continuously produced was performed. After the running test, the color printer was turned off for 24 hours. Next, the color printer was turned on, and a copy of a full-page black half-tone image with 1200 dpi and 2 by 2 was produced to evaluate evenness of image density of the half tone image produced. These image forming operations were performed under environmental conditions of 15° C. and 20% RH. The evenness of image density was graded as follows.

◎: The half-tone image has no strip-shaped uneven density portion having the same width as that of the corona charger.

○: The half-tone image has a faint strip-shaped uneven density portion having the same width as that of the corona charger, but the image quality is on an acceptable level.

X: The half-tone image has a clear strip-shaped uneven density portion having the same width as that of the corona charger, and the image quality is on an unacceptable level.

3. Blurring of Images Produced by the Photoreceptor

A photoreceptor was allowed to settle for 72 hours in a NOx exposure tester (from Dylec Inc.) in which each of NO and $NO_2$ is included at a concentration of 50 ppm. Thereafter, the photoreceptor was set in the black image forming station of the modified full color printer PRO C900 from Ricoh Co., Ltd., which uses a corona charger for charging the circumferential surface of the photoreceptor, which charger had been used (i.e., discharged) for 200 hours or more, and a copy of a full-page black half-tone image was produced to determine whether the half-tone image is blurred. The blurring property was graded as follows.

◎: The image is not blurred.

○: The image is slightly blurred, but the image quality is on an acceptable level.

X: The image is blurred, and the image quality is on an unacceptable level.

4. Abrasion Resistance of the Photoreceptors

A photoreceptor was set in the black image forming station of the modified full color printer PRO C900 from Ricoh Co., Ltd., which uses a corona charger for charging the circumferential surface of the photoreceptor, which charger had been used (i.e., discharged) for 200 hours or more, and a running test in which 200,000 copies of an A-4 size half-tone test chart including only black half-tone images having an image area proportion of 5% are continuously produced was performed. This running test was performed under normal temperature and humidity conditions. The thickness of the photoreceptor was checked before and after the running test to determine the abrasion loss of the protective layer.

The evaluation results are shown in Table 1 below.

TABLE 1

| | Potential of irradiated portions (−V) | Evenness of image density | Blurring of image | Abrasion loss (μm) |
|---|---|---|---|---|
| Ex. 1 | 115 | ◎ | ◎ | 1.1 |
| Ex. 2 | 114 | ◎ | ◎ | 1.0 |
| Ex. 3 | 123 | ◎ | ◎ | 1.2 |
| Ex. 4 | 125 | ◎ | ◎ | 1.1 |
| Ex. 5 | 123 | ◎ | ◎ | 0.8 |
| Ex. 6 | 113 | ◎ | ◎ | 0.9 |
| Ex. 7 | 128 | ◎ | ○ | 1.0 |
| Ex. 8 | 134 | ○ | ○ | 1.1 |
| Ex. 9 | 138 | ◎ | ◎ | 1.1 |
| Ex. 10 | 105 | ◎ | ◎ | 1.1 |
| Ex. 11 | 95 | ◎ | ◎ | 1.3 |
| Ex. 12 | 98 | ◎ | ◎ | 1.5 |
| Ex. 13 | 95 | ◎ | ◎ | 1.7 |
| Ex. 14 | 95 | ◎ | ◎ | 1.0 |
| Ex. 15 | 121 | ◎ | ◎ | 0.8 |
| Ex. 16 | 125 | ○ | ○ | 0.7 |
| Ex. 17 | 134 | ◎ | ○ | 0.8 |
| Ex. 18 | 124 | ◎ | ◎ | 0.9 |
| Ex. 19 | 127 | ○ | ○ | 0.7 |
| Ex. 20 | 133 | ◎ | ◎ | 0.8 |
| Ex. 21 | 138 | ○ | ○ | 0.9 |
| Ex. 22 | 112 | ◎ | ○ | 0.5 |
| Ex. 23 | 116 | ◎ | ○ | 0.6 |
| Ex. 24 | 104 | ○ | ○ | 0.6 |
| Ex. 25 | 101 | ○ | ○ | 0.7 |
| Comp. Ex. 1 | 248 | ◎ | ○ | 1.0 |
| Comp. Ex. 2 | 231 | ◎ | ○ | 1.1 |
| Comp. Ex. 3 | 265 | ◎ | ○ | 1.1 |
| Comp. Ex. 4 | 236 | ◎ | ○ | 1.3 |
| Comp. Ex. 5 | 278 | ◎ | ○ | 1.4 |
| Comp. Ex. 6 | 135 | X | X | 0.7 |
| Comp. Ex. 7 | 146 | X | X | 0.7 |
| Comp. Ex. 8 | 139 | X | X | 0.8 |
| Comp. Ex. 9 | 128 | X | X | 0.7 |

It is clear from Table 1 that the photoreceptors of Examples 1-25 have good abrasion resistance and hardly cause the uneven density image problem and the irradiated-portion potential increasing problem. In contrast, the photoreceptors of Comparative Examples 1-5 cause the irradiated-portion potential increasing problem when used for a long period of time because the photoreceptors do not include a compound having formula (2) or (3). In addition, the photoreceptors of Comparative Examples 6-9 cause the uneven density problem when used for a long period of time because the photoreceptors do not include a compound having formula (1).

Additional modifications and variations of the present invention are possible in light of the above teachings. It is therefore to be understood that within the scope of the appended claims the invention may be practiced other than as specifically described herein.

What is claimed is:

1. A photoreceptor comprising:

an electroconductive substrate;

a photosensitive layer located overlying the electroconductive substrate; and a protective layer located overlying the photosensitive layer, wherein the protective layer includes a crosslinked resin, which is crosslinked by irradiation with ultraviolet rays and which is formed by crosslinking a coating liquid, wherein the coating liquid comprises:

(I) a radically polymerizable compound having a charge transport structure;

(II) a compound having a residual group of a polycarboxylic acid compound and a group having the following formula (10):

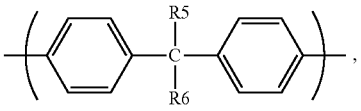

(10)

wherein each of R5 and R6 independently represents a hydrogen atom, or a substituted or unsubstituted alkyl group having 1 to 3 carbon atoms; and (III) at least one of a compound having the below-mentioned formula (2) and a compound having the below-mentioned formula (3):

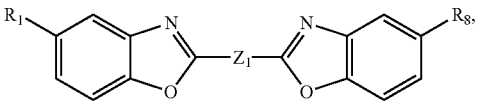

(2)

wherein each of $R_7$ and $R_8$ independently represents a hydrogen atom, or an alkyl group having 1 to 4 carbon atoms, and $Z_1$ represents a vinylene group, a divalent aromatic hydrocarbon group having 6 to 14 carbon atoms, or a 2,5-thiophenediyl group, and

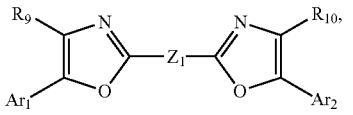

(3)

wherein each of $Ar_1$ and $Ar_2$ independently represents an aromatic group having 6 to 14 carbon atoms, $Z_2$ represents a divalent aromatic hydrocarbon group having 6 to 14 carbon atoms, and each of $R_9$ and $R_{10}$ independently represents a hydrogen atom, or a methyl group, wherein the at least one of the compound having formula (2) and the compound having formula (3) is included in the composition in an amount of from not less than 0.5% to 3% by weight based on a weight of the radically polymerizable compound having a charge transport structure.

2. The photoreceptor according to claim 1, wherein a group of the crosslinked resin has the following formula (11):

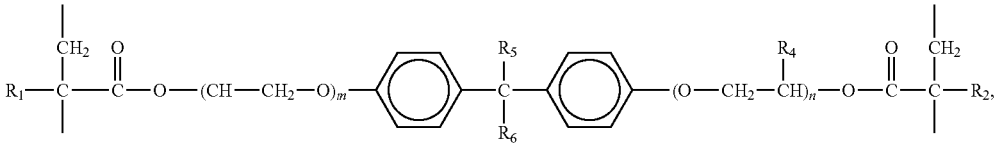

(11)

wherein each of $R_1$, $R_2$, $R_3$, $R_4$, $R_5$ and $R_6$ independently represents a hydrogen atom, or a substituted or unsubstituted alkyl group having 1 to 3 carbon atoms, and each of m and n is independently an integer of from 1 to 5.

3. The photoreceptor according to claim 2, wherein the crosslinked resin is obtained by crosslinking a composition including:

a radically polymerizable compound having a charge transport structure;

a compound having the following formula (1):

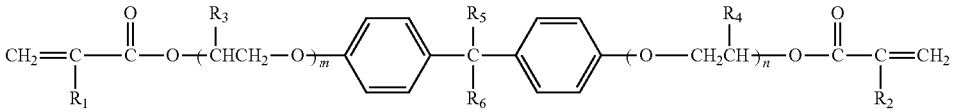

(1)

wherein each of $R_1$, $R_2$, $R_3$, $R_4$, $R_5$ and $R_6$ independently represents a hydrogen atom, or a substituted or unsubstituted alkyl group having 1 to 3 carbon atoms, and each of m and n is independently an integer of from 1 to 5; and at least one of the compound having formula (2), and the compound having formula (3).

4. The photoreceptor according to claim 3, wherein each of m and n in formula (1) is independently 1 or 2, and wherein a total of m and n is from 2 or 3.

5. The photoreceptor according to claim 3, wherein the composition further includes a tri- or more-functional radically polymerizable compound having no charge transport structure.

6. The photoreceptor according to claim 3, wherein the radically polymerizable compound having a charge transport structure is a monofunctional radically polymerizable compound.

7. The photoreceptor according to claim 1, wherein the protective layer further includes a filler.

8. The photoreceptor according to claim 7, wherein the filler is an inorganic filler.

9. The photoreceptor according to claim 8, wherein the inorganic filler includes at least one selected from the group consisting of silicon oxide fillers, titanium oxide fillers, and aluminum oxide fillers.

10. An image forming apparatus comprising:

the photoreceptor according to claim 1;

a charger to subject a surface of the photoreceptor to corona charging;

an irradiator to irradiate the charged photoreceptor with light to form an electrostatic latent image on the surface of the photoreceptor;

a developing device to develop the electrostatic latent image using a toner to form a toner image on the surface of the photoreceptor; and a transferring device to transfer the toner image onto a recording medium.

11. A process cartridge comprising:

at least the photoreceptor according to claim 1; and a charger to subject the photoreceptor to corona charging, wherein the process cartridge is detachably attachable to an image forming apparatus as a single unit.

12. A method for preparing the photoreceptor according to claim 1, comprising:

forming the photosensitive layer overlying the electroconductive substrate;

applying a coating liquid including a protective layer composition overlying the photosensitive layer, wherein the protective layer composition comprises:

(I) a radically polymerizable compound having a charge transport structure;

(II) a compound having formula (1); and (III) at least one of a compound having formula (2) or a compound having formula (3); and irradiating the applied coating liquid with ultraviolet rays to crosslink the protective layer composition to form the protective layer.

13. A photoreceptor comprising:

an electroconductive substrate;

a photosensitive layer located overlying the electroconductive substrate; and a protective layer located overlying the photosensitive layer, wherein the protective layer includes a crosslinked resin, which is crosslinked by irradiation with ultraviolet rays and which is formed by crosslinking a coating liquid, wherein the coating liquid comprises:

(I) a radically polymerizable compound having a charge transport structure;

(II) a compound having a residual group of a polycarboxylic acid compound and a group having the following formula (10):

(10)

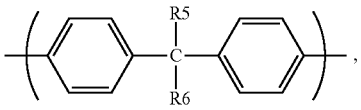

wherein each of R5 and R6 independently represents a hydrogen atom, or a substituted or unsubstituted alkyl group having 1 to 3 carbon atoms; and (III) at least one of a compound having the below-mentioned formula (2) and a compound having the below-mentioned formula (3):

(2)

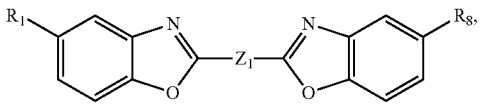

wherein each of $R_7$ and $R_8$ independently represents a hydrogen atom, or an alkyl group having 1 to 4 carbon atoms, and $Z_1$ represents a vinylene group or a divalent aromatic hydrocarbon group having 6 to 14 carbon atoms, and (3)

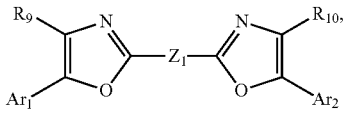

wherein each of $Ar_1$ and $Ar_2$ independently represents an aromatic group having 6 to 14 carbon atoms, $Z_2$ represents a divalent aromatic hydrocarbon group having 6 to 14 carbon atoms, and each of $R_9$ and $R_{10}$ independently represents a hydrogen atom, or a methyl group.

14. The photoreceptor according to claim 13, wherein the coating liquid comprises at least one compound of formula (2) selected from the group consisting of:

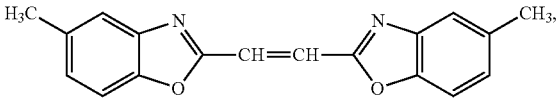

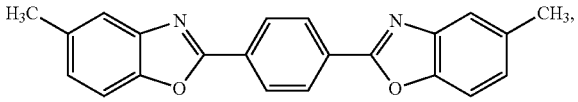

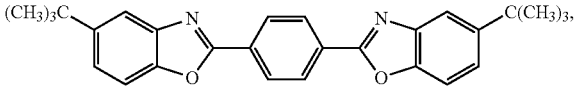

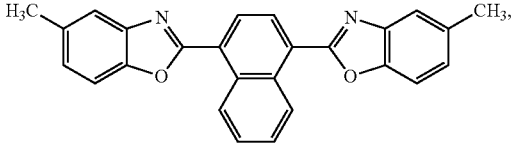

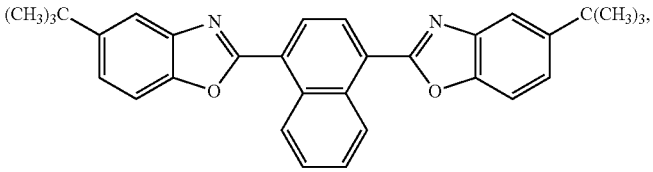

and

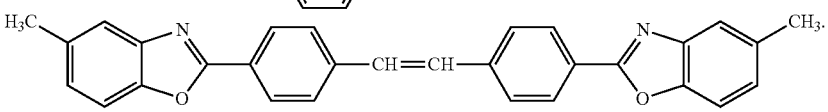

15. The photoreceptor according to claim 13, wherein the coating liquid comprises at least one compound of formula (3) selected from the group consisting of:

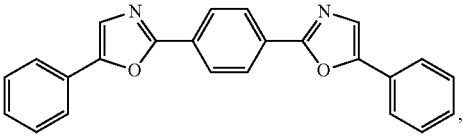

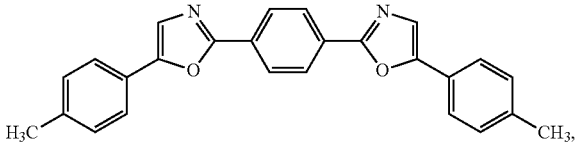

-continued

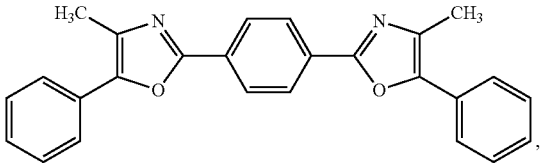

, and

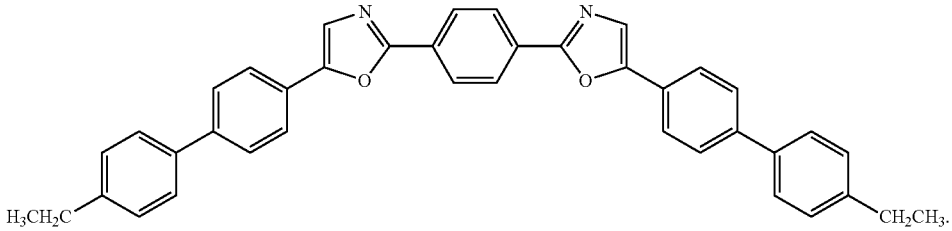

16. A method for preparing a photoreceptor, comprising:

forming a photosensitive layer overlying an electroconductive substrate;

applying a coating liquid including a protective layer composition overlying the photosensitive layer; and irradiating the applied coating liquid with ultraviolet rays to crosslink the protective layer composition, wherein the protective layer composition includes:

(I) a radically polymerizable compound having a charge transport structure;

(II) a compound having the following formula (1):

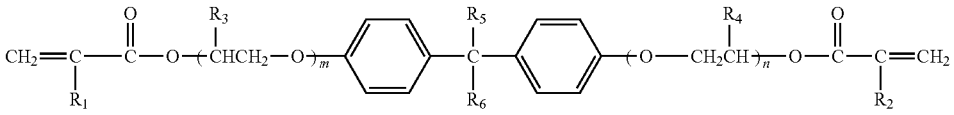

(1)

wherein each of $R_1$, $R_2$, $R_3$, $R_4$, $R_5$ and $R_6$ independently represents a hydrogen atom, or a substituted or unsubstituted alkyl group having 1 to 3 carbon atoms, and each of m and n is independently an integer of from 1 to 5; and (III) at least one of a compound having the following formula (2):

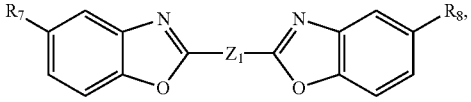

(2)

wherein each of $R_7$ and $R_8$ independently represents a hydrogen atom, or an alkyl group having 1 to 4 carbon atoms, and $Z_1$ represents a vinylene group or a divalent aromatic hydrocarbon group having 6 to 14 carbon atoms; and a compound having the following formula (3):

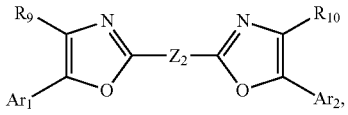

(3)

wherein each of $Ar_1$ and $Ar_2$ independently represents an aromatic group having 6 to 14 carbon atoms, $Z_2$ represents a divalent aromatic hydrocarbon group having 6 to 14 carbon atoms, and each of $R_9$ and $R_{10}$ independently represents a hydrogen atom, or a methyl group.

* * * * *